US008693924B2

(12) United States Patent
Fujii

(10) Patent No.: US 8,693,924 B2
(45) Date of Patent: Apr. 8, 2014

(54) DEVELOPER CARTRIDGE INCLUDING DEFORMATION PREVENTING PROJECTIONS, IMAGE FORMING UNIT AND IMAGE FORMING APPARATUS

(75) Inventor: Masashi Fujii, Tokyo (JP)

(73) Assignee: Oki Data Corporation, Tokyo (JP)

( * ) Notice: Subject to any disclaimer, the term of this patent is extended or adjusted under 35 U.S.C. 154(b) by 706 days.

(21) Appl. No.: 12/942,274

(22) Filed: Nov. 9, 2010

(65) Prior Publication Data

US 2011/0129260 A1 Jun. 2, 2011

(30) Foreign Application Priority Data

Dec. 2, 2009 (JP) ..... 2009-274731

(51) Int. Cl.
*G03G 15/08* (2006.01)

(52) U.S. Cl.
CPC ..... *G03G 15/0836* (2013.01); *G03G 2215/067* (2013.01); *G03G 2215/0673* (2013.01)
USPC ..... 399/262; 399/106

(58) Field of Classification Search
CPC ..... G03G 15/0836; G03G 15/0837; G03G 2215/0673; G03G 2215/067
USPC ..... 399/106, 262; 222/DIG. 1
See application file for complete search history.

(56) References Cited

U.S. PATENT DOCUMENTS

| | | | | |
|---|---|---|---|---|
| 5,678,147 | A * | 10/1997 | Makino | 222/DIG. 1 |
| 5,842,092 | A * | 11/1998 | Jyoroku | 399/262 |
| 2011/0064480 | A1* | 3/2011 | Nakasone | 399/262 |

FOREIGN PATENT DOCUMENTS

| | | |
|---|---|---|
| JP | A-H06-186845 | 7/1994 |
| JP | A-H11-223990 | 8/1999 |
| JP | A-2005-024759 | 1/2005 |
| JP | A-2006-243446 | 9/2006 |
| JP | A-2008-076697 | 4/2008 |
| JP | A-2009-058722 | 3/2009 |

* cited by examiner

*Primary Examiner* — David Gray
*Assistant Examiner* — Laura Roth
(74) *Attorney, Agent, or Firm* — Muncy, Geissler, Olds & Lowe, P.C.

(57) ABSTRACT

A developer cartridge includes a developer container, an opening and a first projection. The developer container holds a developer. The opening, which is formed on the developer container, extends in a longitudinal direction of the developer container. The first projection is formed in the vicinity of the opening.

24 Claims, 21 Drawing Sheets

35
133
133
133

DEVELOPER CARTRIDGE INCLUDING DEFORMATION PREVENTING PROJECTIONS, IMAGE FORMING UNIT AND IMAGE FORMING APPARATUS

CROSS-REFERENCE TO RELATED APPLICATION

This application claims priority based on 35 U.S.C. §119 from prior Japanese Patent Application No. P 2009-274731, filed on Dec. 2, 2009, the entire contents of which are incorporated herein by reference.

BACKGROUND

This application relates to a developer cartridge that holds a developer therein. This application also relates to an image forming unit and an image forming apparatus that include the developer cartridge.

A developer cartridge has an opening at its bottom portion, which extends in the longitudinal direction of the cartridge, to supply a developer to an image-forming unit. The cartridge also has a shutter to open and close the opening. The shutter is rotatable around a rotational axis, which extends in the longitudinal direction along an inside wall of the cartridge surrounding the opening. The shutter has a sealing member that covers the opening so as to prevent the developer from leaking from the cartridge when the shutter keeps the opening closed. Japanese Laid-Open Patent No. 2006-243446 discloses one such developer cartridge.

In such a developer cartridge, however, the opening is liable to be deformed by an external force when the cartridge, which is mounted on the image-image forming unit, is replaced with a new one. The deformation of the opening causes gaps to form between the opening and the sealing member, resulting in the leakage of the developer from the opening through the gaps.

SUMMARY

An object of the application is to disclose a developer cartridge, an image forming unit and an image forming apparatus that are capable of preventing a developer from leaking from an opening even if the cartridge is subjected to an external force in the condition where a shutter keeps the opening closed.

According to one aspect, a developer cartridge includes a developer container, an opening and a first projection. The developer container holds a developer. The opening, which is formed on the developer container, extends in a longitudinal direction of the developer container. The first projection is formed in the vicinity of the opening.

According to another aspect, an image forming unit includes an image bearing body, a developing unit and a developer cartridge. The developing unit is configured to develop an electrostatic latent image, which is formed on the image bearing body, with a developer. The developer cartridge is configured to supply the developer to the developing unit. The developer cartridge also has a developer container, an opening and a first projection. The developer container holds the developer. The opening, which is formed on the developer container, extends in a longitudinal direction of the developer container. The first projection is formed in the vicinity of the opening.

According to yet another aspect, an image forming apparatus includes the image forming unit, a transfer unit and a fixing unit. The image forming unit forms an image. The transfer unit transfers the image to a medium. The fixing unit fixes the image onto the medium.

In further aspect, a developer cartridge includes a developer container and a plurality of first projections. The developer container holds a developer and includes an opening that extends in a longitudinal direction of the developer container. The plurality of first projections are formed at least partially in the vicinity of the opening along a plurality of respective imaginary planes perpendicular to the longitudinal direction.

The full scope of applicability of the developer cartridge, the image forming unit and the image forming apparatus will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The developer cartridge, the image forming unit, and the image forming apparatus will be more fully understood from the following detailed description with reference to the accompanying drawings, which are given by way of illustration only, and should not limit the invention, wherein.

DETAILED DESCRIPTION

Preferred embodiments of a developer cartridge, an image forming unit, and an image forming apparatus according to the invention will be described in detail with reference to the accompanying drawings. In each disclosed embodiment, the description will be given with reference to an electrophotographic color printer as an image forming apparatus.

First Disclosed Embodiment

Figure 1:
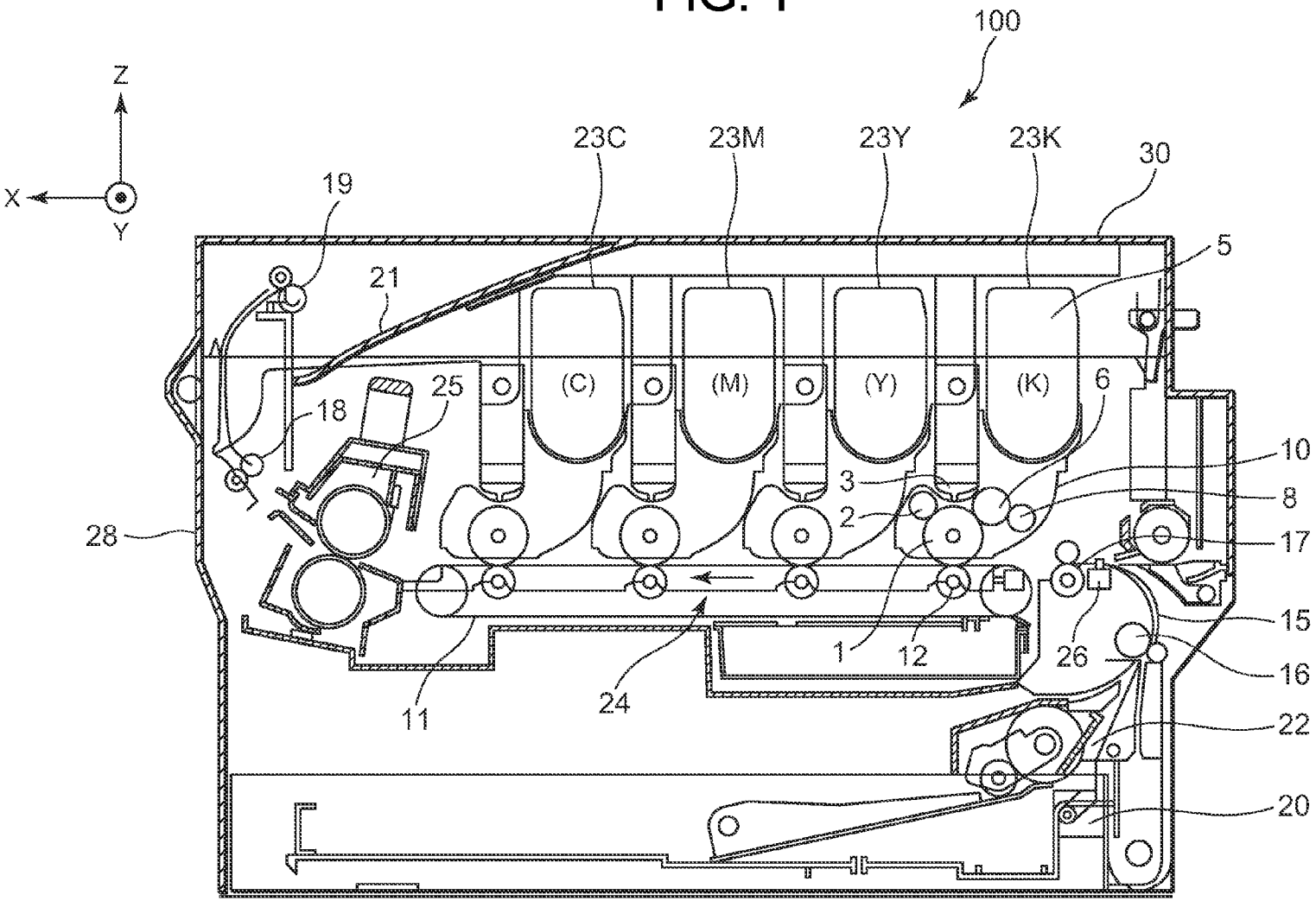
FIG. 1 is a schematic view of a printer according to a first disclosed embodiment.

FIG. 1 is a schematic view of a printer 100 of a first disclosed embodiment, which may include a sheet path 15, a sheet cassette 20, a sheet feeder 22, transport rollers 16, 17, 18 and 19, a sheet thickness sensor 26, image-forming units 23K, 23Y, 23M, and 23C, a transfer unit 24, a fixing unit 25 and a stacker 21.

The sheet path ("the path") 15, which is substantially S-shaped, is provided in a lower frame 28 of the printer 100. The sheet cassette 20 and the stacker 21 are respectively provided at one end and at the other end of the path 15. The sheet cassette 20 accommodates a stack of sheets. The sheet feeder 22 feeds the sheet from the sheet cassette 20 into the path 15. The transport rollers 16, 17, 18, and 19, which are disposed along the path 15, transport the sheet. The sheet thickness sensor 26 detects the thickness of the sheet. The image-forming units 23K, 23Y, 23M, and 23C, which are detachably mounted on the printer 100, respectively form a black toner image, a yellow toner image, a magenta toner image and a cyan toner image.

The transfer unit 24 includes a transfer belt 11, which transports the sheet while electrostatically adhering it. The transfer unit 24 is disposed opposite to the image-forming units 23K, 23Y, 23M, and 23C, and transfers the toner images formed by the image-forming units 23K, 23Y, 23M, and 23C to the sheet on the transfer belt 11. The fixing unit 25 includes a heat roller and a backup roller, and fixes the toner images onto the sheet. The stacker 21 holds the sheet on which the toner images are fixed. The image-forming units 23K, 23Y, 23M, and 23C, the transfer unit 24, and the fixing unit 25 can be replaced with new ones by opening a top cover 30 of the printer 100.

In FIG. 1, an X-axis, a Y-axis, and a Z-axis respectively denote a transport direction of the sheet on the transfer unit 24, a direction of an axis of rotation of a photosensitive drum 1, described later, and a direction perpendicular to both of these directions, i.e., the vertical direction. It should be noted that the X-axes, the Y-axes, and the Z-axes in other drawings respectively denote the same directions as the X-axis, the Y-axis, and the Z-axis in FIG. 1.

Next, the image-forming units 23K, 23Y, 23M, and 23C will be described in detail. Because the image-forming units 23K, 23Y, 23M, and 23C have the same structure, except for toner colors, the image-forming unit 23K, which forms a black toner image, will be described by way of example here.

Figure 2:
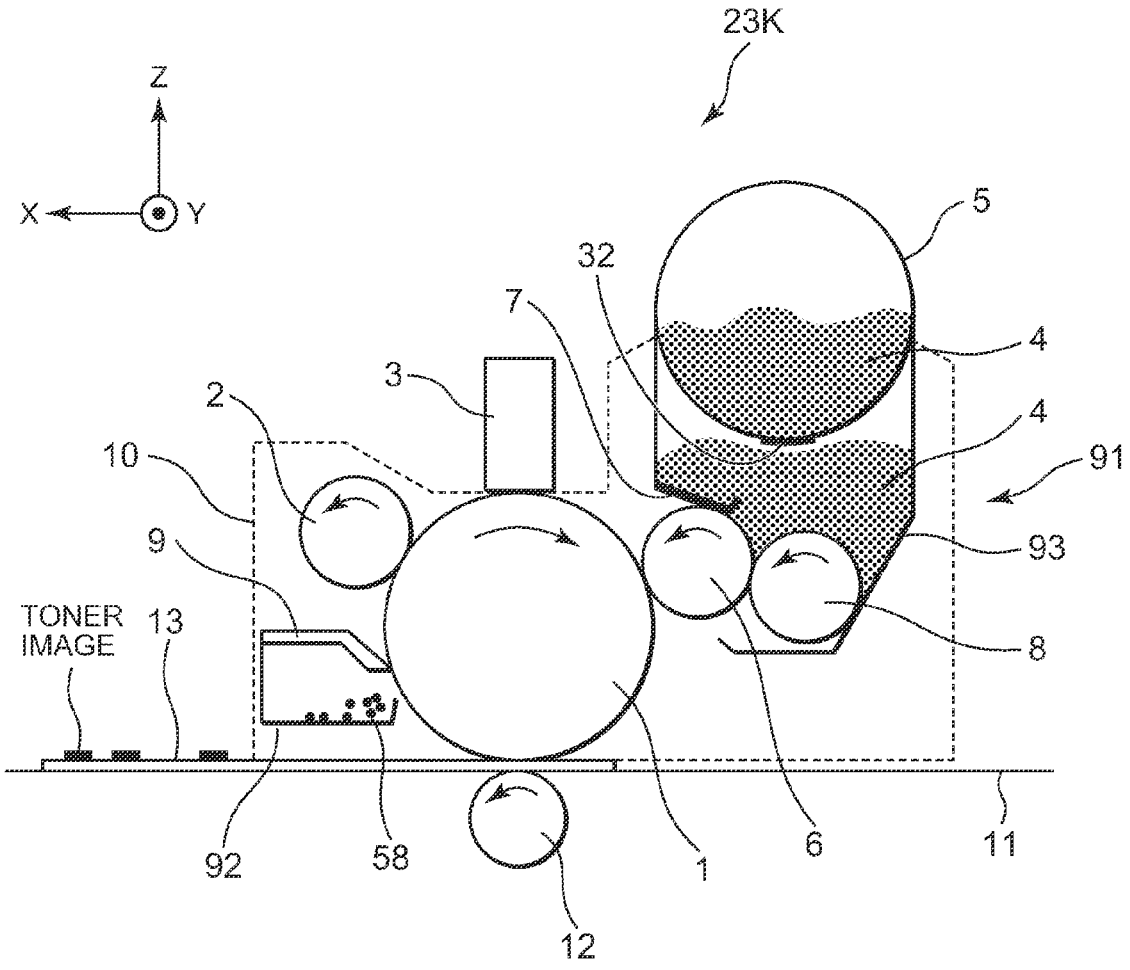
FIG. 2 is a schematic view of an image-forming unit according to the first disclosed embodiment.

FIG. 2 is a schematic view of the image-forming unit 23K, which may incorporate the photosensitive drum 1, a charging roller 2, a developing unit 91, a cleaning blade 9, and a waste toner box 92 in a chassis 10.

The photosensitive drum 1, which operates as an image bearing body, is rotatable in the direction of the disclosed arrow. The charging roller 2 is pressed toward the photosensitive drum 1 and uniformly charges a surface of the photosensitive drum 1 by supplying electric charges to the surface. The charged surface of the photosensitive drum 1 is exposed to light from an exposure head 3, which incorporates multiple light-emitting diodes (LEDs), to form an electrostatic latent image. The exposure head 3 is mounted on the top cover 30 (See, e.g., FIG. 1) of the printer 100.

The developing unit 91 may include a toner storage portion 93, a developing roller 6, a toner supply roller 8 and a developing blade 7. A toner cartridge ("the cartridge") 5 is detachably mounted on the developing unit 91 above the toner storage portion 93. The cartridge 5 operates as a developer cartridge, and holds toner 4, which it uses as a developer. The cartridge 5 has an opening 32 at its bottom portion, which it uses to supply the toner 4 to the toner storage portion 93. The toner storage portion 93 stores the toner 4 supplied from the cartridge 5. The developing roller 6 is pressed toward the photosensitive drum 1, and is rotatable in the direction of the disclosed arrow. The developing roller 6 develops the electrostatic latent image on the photosensitive drum 1 using the toner 4, thereby forming a toner image on the surface of the photosensitive drum 1. The toner supply roller 8 is pressed toward the developing roller 6 and is rotatable in the direction of the disclosed arrow. The toner supply roller 8 supplies the toner 4 stored in the toner storage portion 93 to the developing roller 6. The developing blade 7 has a cross-sectional shape that is substantially L-shaped, and is in pressure contact with the developing roller 6 at its bent portion. The developing blade 7 forms a layer of the toner 4 on the developing roller 6 at a uniform thickness.

The cleaning blade 9, which is elastic, is pressed toward the photosensitive drum 1 and scrapes off any toner 58 that remains on the photosensitive drum 1 after the toner image has been transferred to a sheet 13 from the photosensitive drum 1. The waste toner box 92 collects the scraped-off toner 58.

In addition, a transfer roller 12, which is made of conductive rubber, is provided under the photosensitive drum 1 through the transfer belt 11. The transfer roller 12 receives a voltage from a power supply (not shown) and transfers the toner image from the photosensitive drum 1 to the sheet 13.

Figure 3:
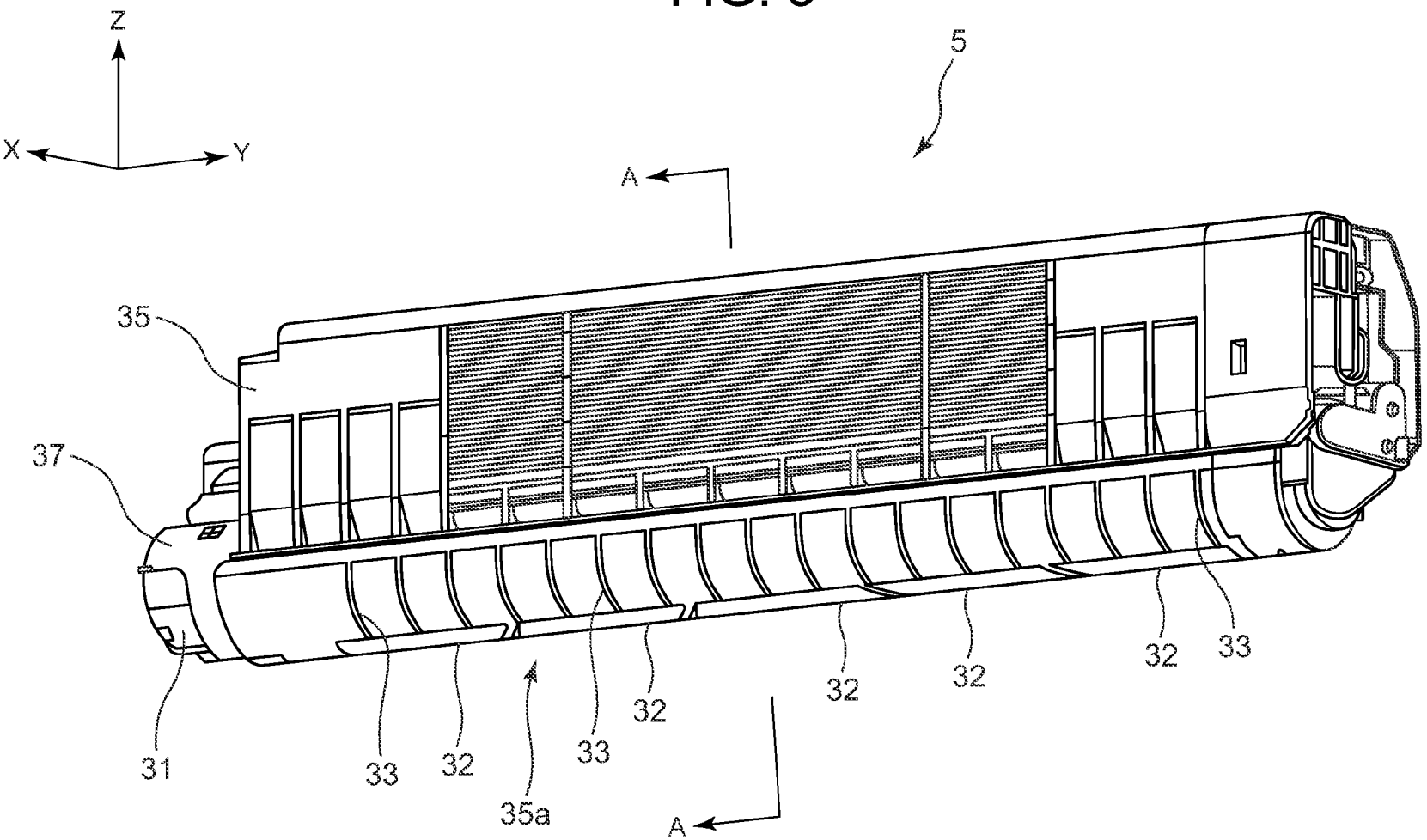
FIG. 3 is a perspective view of a toner cartridge according to the first disclosed embodiment.
Figure 4:
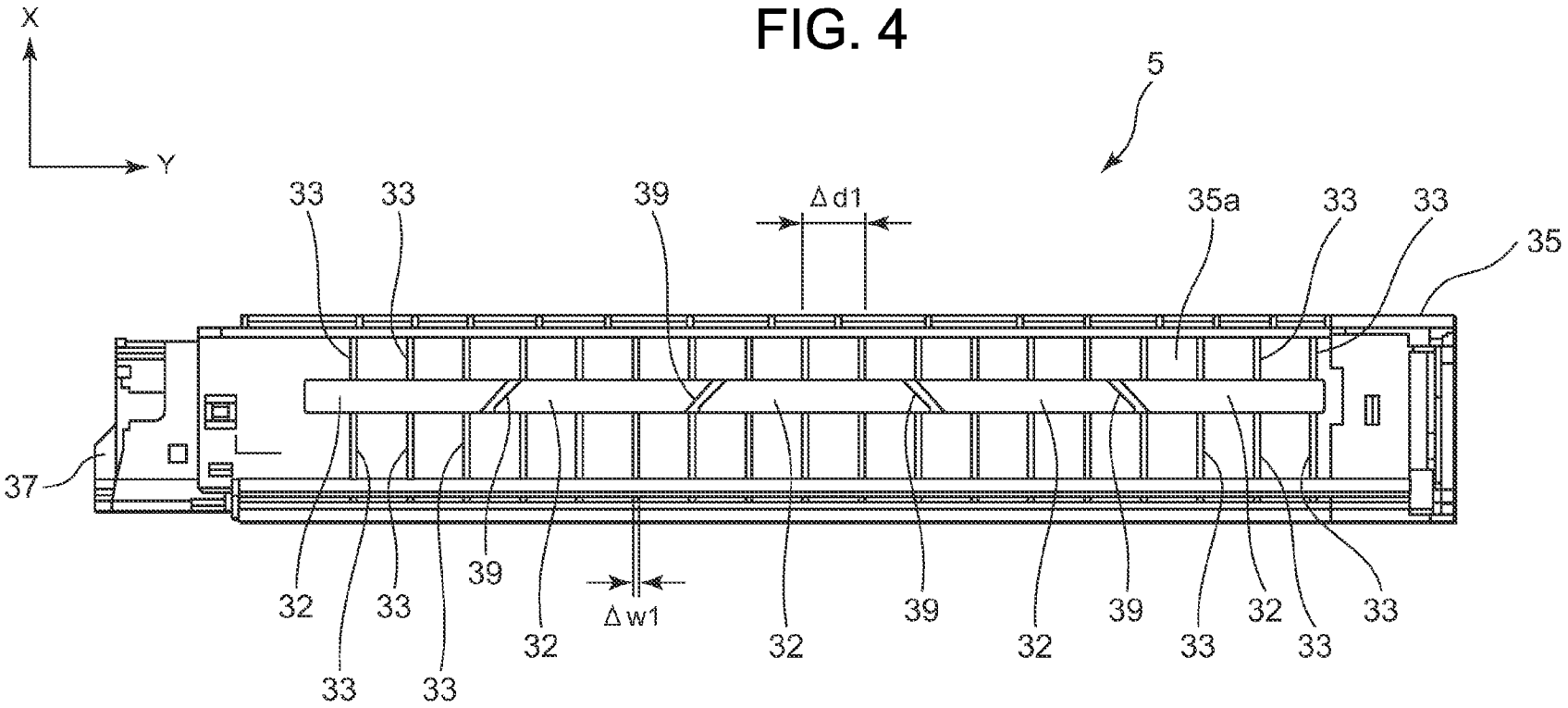
FIG. 4 is a bottom view of the toner cartridge according to the first disclosed embodiment.
Figure 5B:
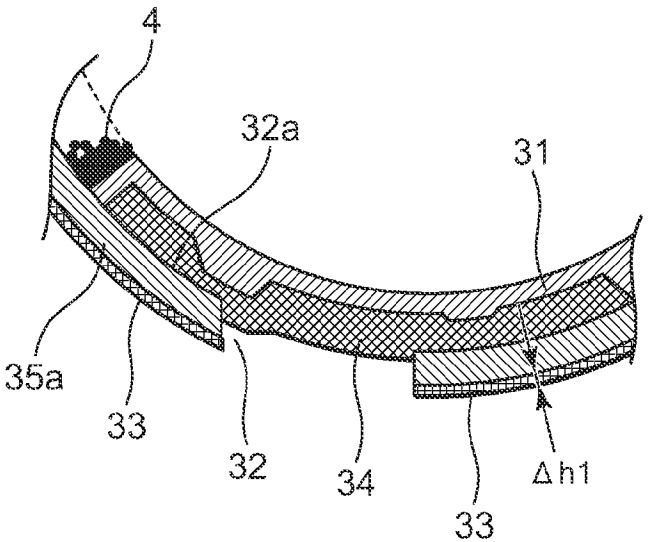
FIG. 5B is an enlarged cross-sectional view of the toner cartridge in an area R of FIG. 5A.
Figure 5A:
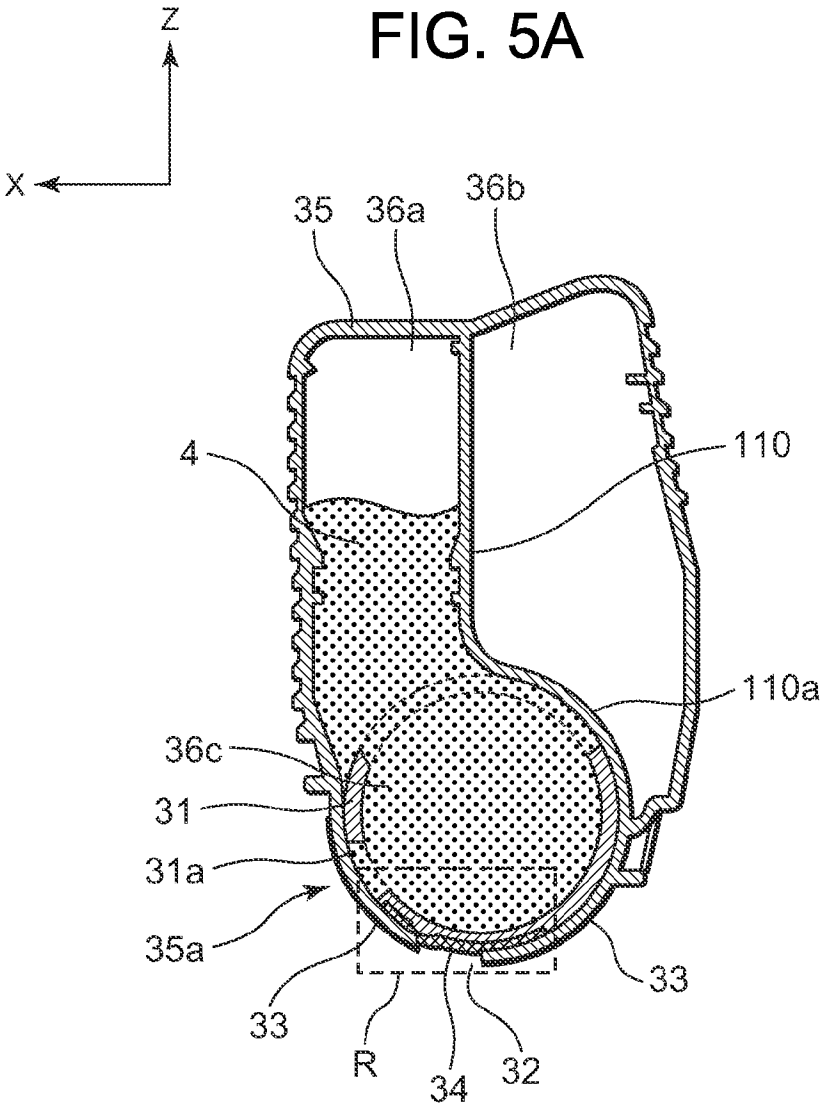
FIG. 5A is a cross-sectional view of the toner cartridge along a line A-A of FIG. 3.

Next, the cartridge 5 will be described in detail. FIGS. 3 and 4 are a perspective view and a bottom view of the cartridge 5, respectively. FIG. 5A is a cross-sectional view of the cartridge 5 along a line A-A of FIG. 3. FIG. 5B is an enlarged cross-sectional view of the cartridge 5 in an area R of FIG. 5A.

As shown in FIGS. 3 and 4, the cartridge 5 includes a housing 35, the opening 32, a shutter 31, and a lever 37. The housing 35, operating as a developer container, holds unused toner and waste toner therein, as described later. The opening 32 is formed at a bottom portion 35*a* of the housing 35, and extends in the longitudinal direction of the housing 35 (i.e., in the Y-axis direction). The shutter 31 opens and closes the opening 32. The lever 37 is attached to the shutter 31, and allows a user to operate the shutter 31.

As shown in FIG. 5A, the interior of the housing 35 is divided into two chambers by a separator 110, which is established throughout the housing 35 in the longitudinal direction (i.e., in the Y-axis direction). One of the chambers is a toner supply chamber 36*a*, which stores the unused toner, and the other is a toner collection chamber 36*b*, which collects the waste toner. The separator 110 extends downwardly (i.e., in the Z-axis direction) from the middle of an upper wall of the housing 35. The separator 110 also curves along a circumference of the shutter 31, which has a semi-cylindrical shape, so that a lower portion of the interior of the housing 35 becomes part of the toner supply chamber 36*a*.

The bottom portion 35*a*, which has a cross-sectional shape that is arc-shaped, forms a cylindrical cavity 36*c* together with a curved portion 110*a* of the separator 110. The shutter 31 is rotatable around its rotational axis, which extends in the longitudinal direction of the housing 35 (i.e., in the Y-axis direction), in the cavity while sliding on an internal wall of the housing 35. The shutter 31 has an opening 31*a*, which can be opposed to the opening 32 formed at the bottom portion 35*a*. The shutter 31 also has a sealing member 34 on its outer circumferential surface. As shown in FIG. 5B, when the shutter 31 keeps the opening 32 closed, i.e., when the shutter 31 is in the closed position, the sealing member 34 covers the opening 32 and an inner surface 32*a* surrounding the opening 32. On the other hand, when the shutter 31 opens the opening 32, i.e., when the shutter 31 is in the open position, the opening 31*a* overlaps the opening 32 so that the toner supply chamber 36*a* is opened to the outside of the cartridge 5.

Referring back to FIG. 4, the housing 35 has multiple ribs 33 that operate as first projections at the bottom portion 35*a*. The ribs 33 are equally spaced from one another at a distance Δd1 and are formed over substantially the entire area of the opening 32 in the longitudinal direction of the housing 35 (i.e., in the Y-axis direction). In addition, each of the ribs 33 is formed along an imaginary plane perpendicular to the longitudinal direction of the housing 35, and has a width Δw1 and a height Δh1 (See, e.g., FIG. 5B). In the first disclosed embodiment, the distance Δd1, the width Δw1 and the height Δh1 are respectively 13.5 mm, 1.5 mm, and 0.3 mm. In the first disclosed embodiment, the housing 35 has 18 ribs 33 on each side of the opening 32, i.e., 36 ribs 33 in total. The housing 35 also has multiple ribs 39 that link both sides of the opening 32. Each of the ribs 39 is arranged at a predetermined angle with respect to the longitudinal direction of the housing 35.

Figure 6:
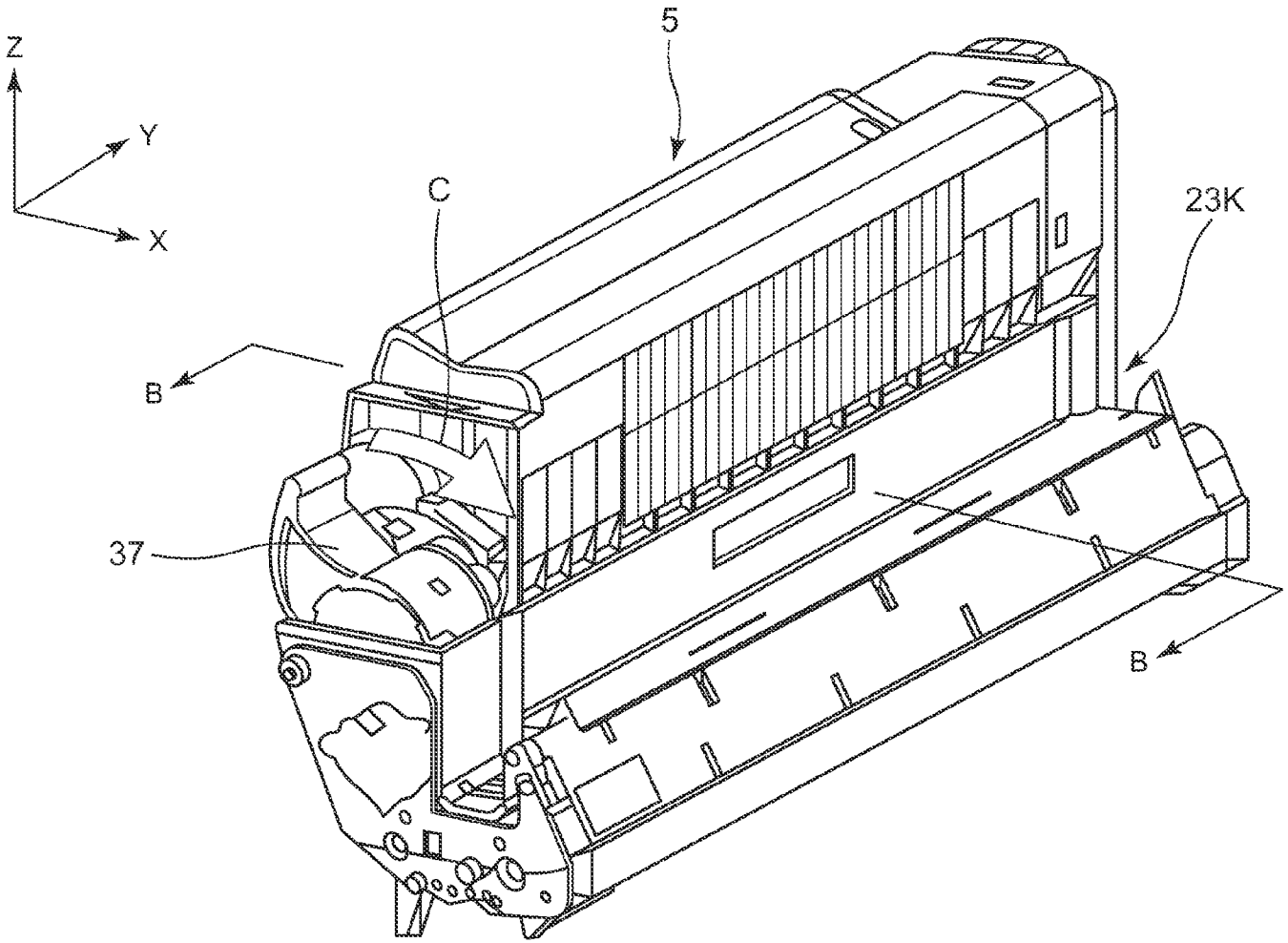
FIG. 6 is a perspective view of the image-forming unit on which the toner cartridge of the first disclosed embodiment is mounted.
Figure 7B:
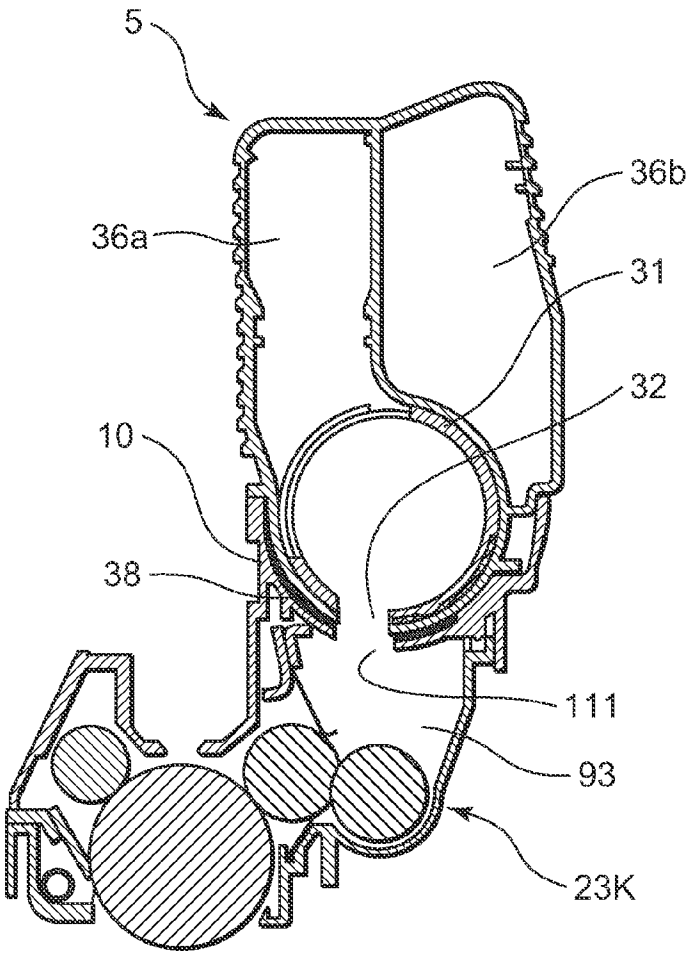
FIG. 7B is a cross-sectional view of the toner cartridge and the image-forming unit along the line B-B in FIG. 6, when a shutter is in the open position.
Figure 7A:
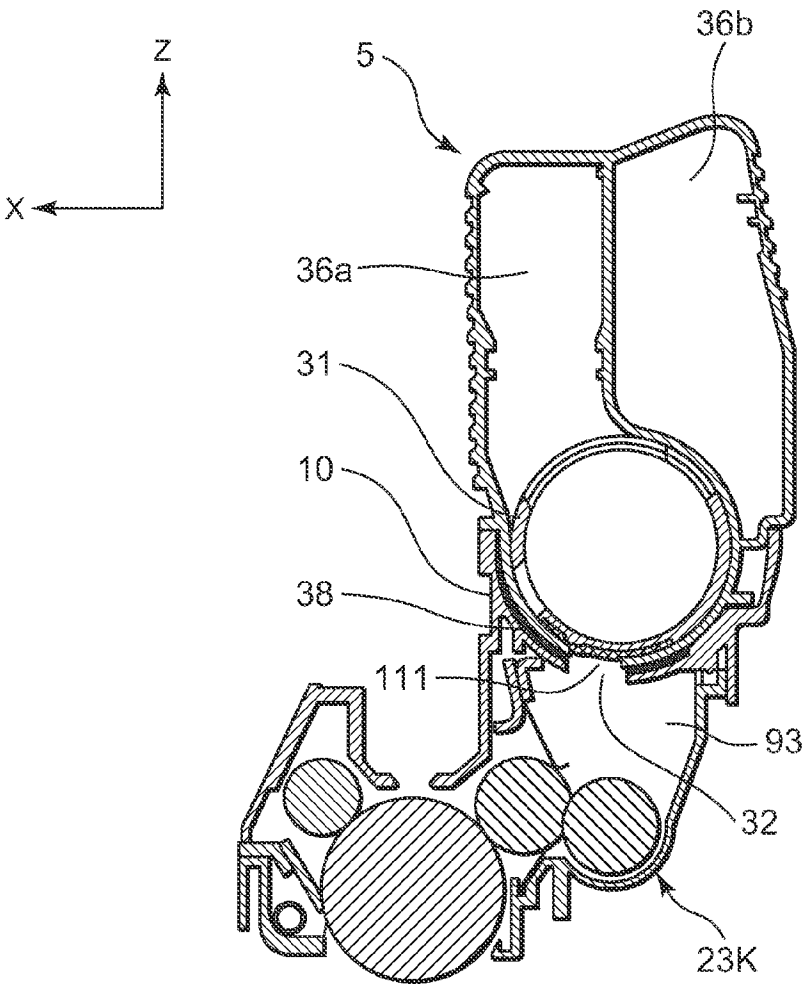
FIG. 7A is a cross-sectional view of the toner cartridge and the image-forming unit along a line B-B in FIG. 6, when a shutter is in the closed position.

FIG. 6 is a perspective view of the image-forming unit 23K on which the cartridge 5 is mounted. FIGS. 7A and 7B are cross-sectional views of the cartridge 5 and the image-forming unit 23K along a line B-B in FIG. 6, when the shutter 31 is respectively in the closed position, and in the open position.

As shown in FIG. 7A, the cartridge 5 is installed onto the image-forming unit 23K in the condition where the shutter 31 is in the closed position. At this time, the opening 32 of the housing 35 opposes a toner inlet 111 that operates as a developer inlet formed on the chassis 10 of the image-forming unit 23K, and is pressed toward the toner inlet 111 through a sealing member 38 provided in the vicinity of the toner inlet 111. Therefore, the toner 4 (See, e.g., FIG. 5A) falling from the cartridge 5 does not leak out of the image-forming unit 23K.

As shown in FIG. 7B, when the user moves the lever 37 in the direction of arrow C in FIG. 6 when the shutter 31 is in the closed position, the shutter 31 rotates to the open position. At this time, the cartridge 5 is fastened to the image-forming unit 23K with a lock mechanism (not shown). Then, the toner 4 (See, e.g., FIG. 5A) is supplied from the toner supply chamber 36*a* to the toner storage portion 93 of the image-forming unit 23K through the opening 32 and the toner inlet 111.

Next, a printing operation of the printer 100 will be described with reference to FIGS. 1 and 2. When the printing operation is initiated, the sheet feeder 22 feeds a sheet from the sheet cassette 20 into the sheet path 15. The transport rollers 16 and 17 transport the sheet to the transfer unit 24. The sheet thickness sensor 26 detects the thickness of the sheet transported by the transport rollers 16 and 17.

Meanwhile, in the image-forming unit 23K, the charging roller 2 uniformly charges a surface of the photosensitive drum 1. The exposure head 3 exposes the charged surface of the photosensitive drum 1 to light to form an electrostatic latent image. The toner supply roller 8 supplies the toner 4, which is supplied from the toner supply chamber 36*a* of the cartridge 5, to the developing roller 6. The developing blade 7 forms a layer of the toner 4 on the developing roller 6 at a uniform thickness. The developing roller 6 develops the latent image with the toner 4, thereby forming a black toner image on the surface of the photosensitive drum 1. The transfer roller 12 transfers the black toner image on the photosensitive drum 1 to the sheet. The cleaning blade 9 scrapes the toner 58, which remains on the photosensitive drum 1 after the black toner image has been transferred to the sheet, off the photosensitive drum 1. The waste toner box 92 collects the scraped-off toner 58.

In a manner similar to the image-forming unit 23K, the image-forming units 23Y, 23M, and 23C respectively form a yellow toner image, a magenta toner image, and a cyan toner image. The transfer unit 24 transfers these toner images to the sheet on the transfer belt 11 in series. The fixing unit 25 fixes the toner images onto the sheet. The transport rollers 18 and 19 transport the sheet with the toner images thereon to the stacker 21.

Next, advantages of the ribs 33 of the cartridge 5 will be described in comparison to a toner cartridge 405 of a first comparison example and a toner cartridge 505 of a second comparison example.

First, a case where an external force Fa is applied to each of the cartridges 5 and 405 will be described.

Figure 8B:
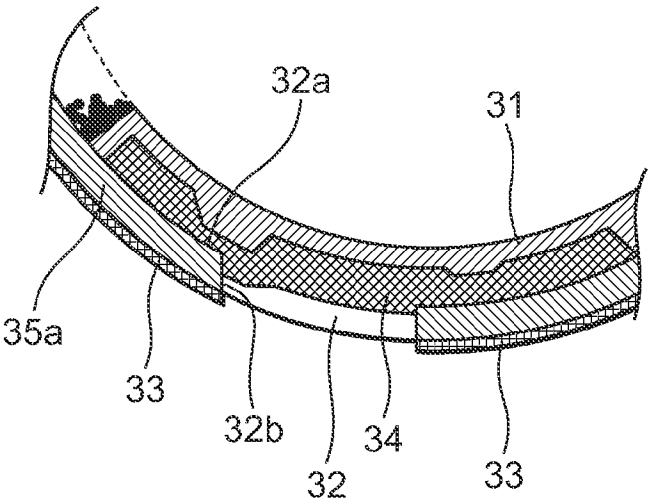
FIG. 8B is an enlarged cross-sectional view of the toner cartridge in an area R of FIG. 8A.
Figure 8A:
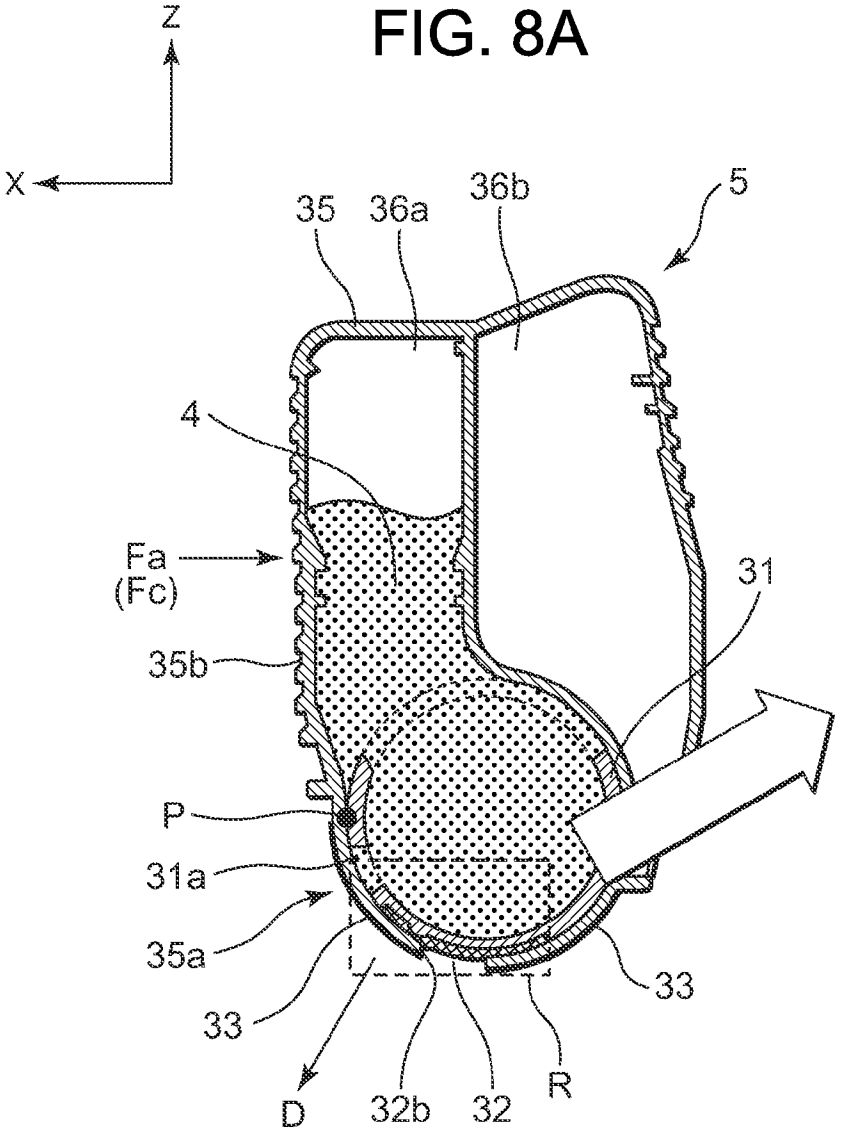
FIG. 8A is a cross-sectional view of the toner cartridge according to the first disclosed embodiment, when an external force Fa is applied from the side in the condition where the shutter is in the closed position.

FIG. 8A is a cross-sectional view of the cartridge 5 of the first disclosed embodiment, when the external force Fa is applied from the side in the condition where the shutter 31 is in the closed position. FIG. 8B is an enlarged cross-sectional view of the cartridge 5 in an area R of FIG. 8A. In FIG. 8A, the cartridge 5 is fastened so as not to move in the direction of the force Fa.

Figure 9:
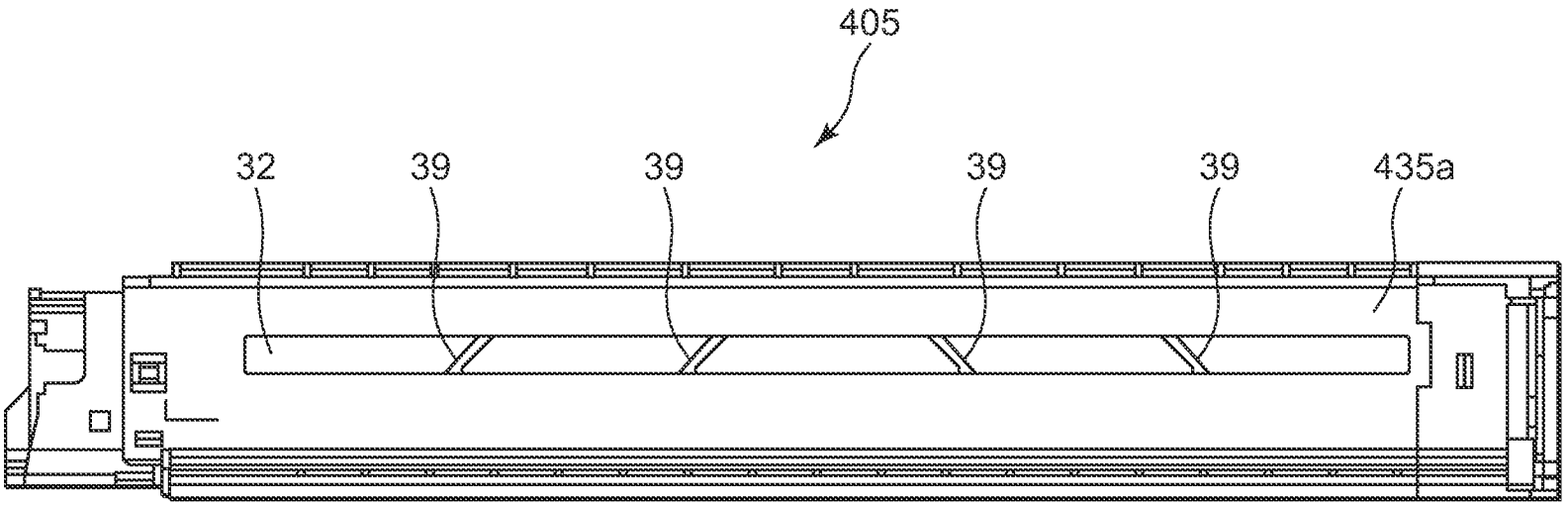
FIG. 9 is a bottom view of a toner cartridge according to a first comparison example.
Figure 10B:
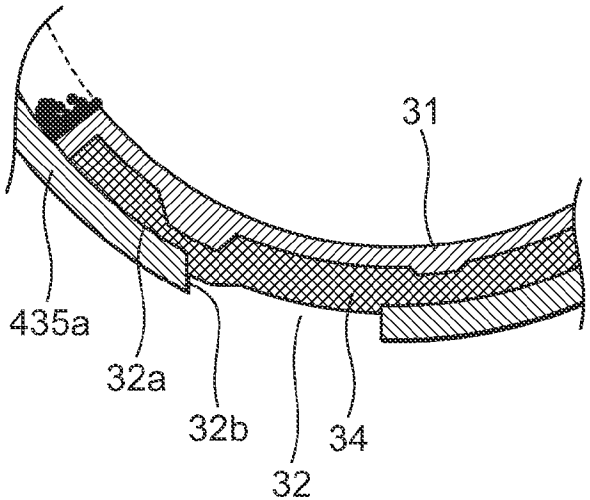
FIG. 10B is an enlarged cross-sectional view of the toner cartridge in an area R of FIG. 10A.
Figure 10A:
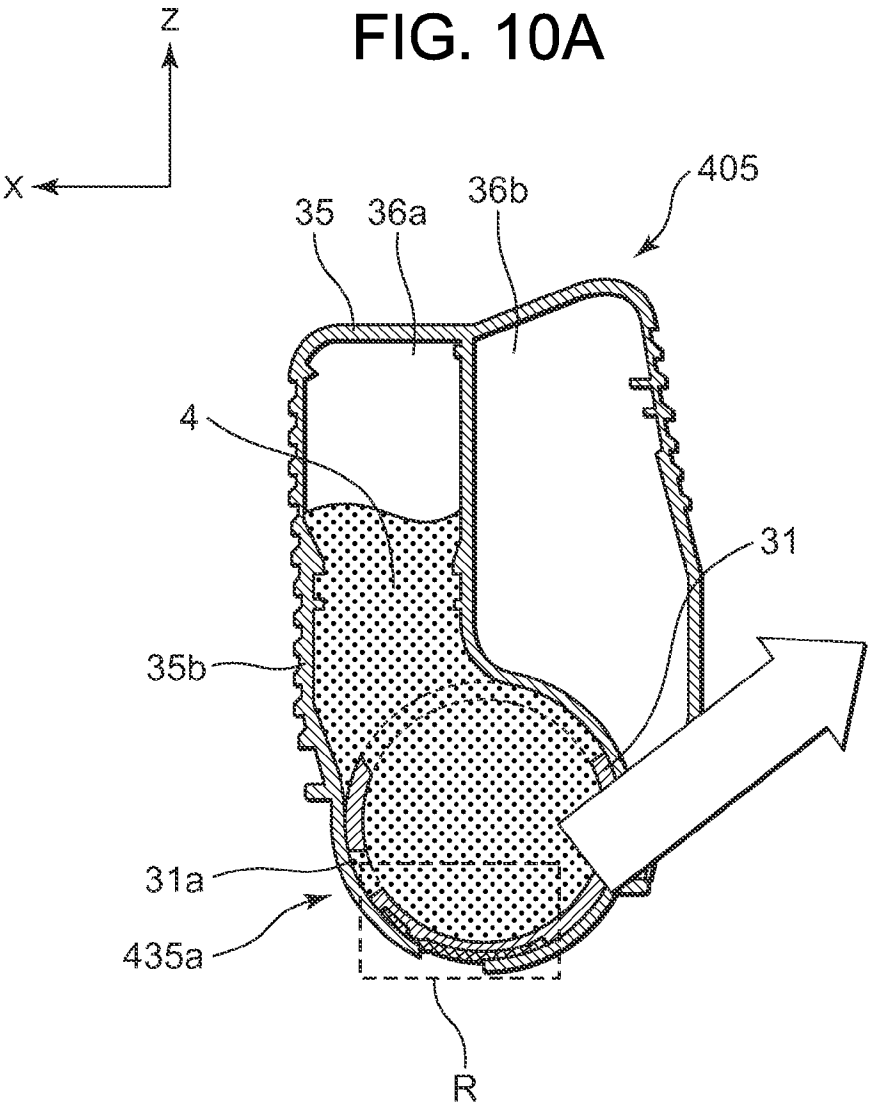
FIG. 10A is a cross-sectional view of the toner cartridge according to the first comparison example.
Figure 11B:
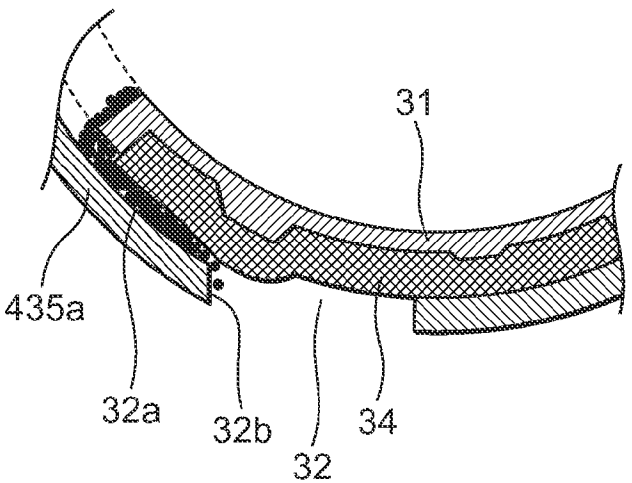
FIG. 11B is an enlarged cross-sectional view of the toner cartridge in an area R of FIG. 11A.
Figure 11A:
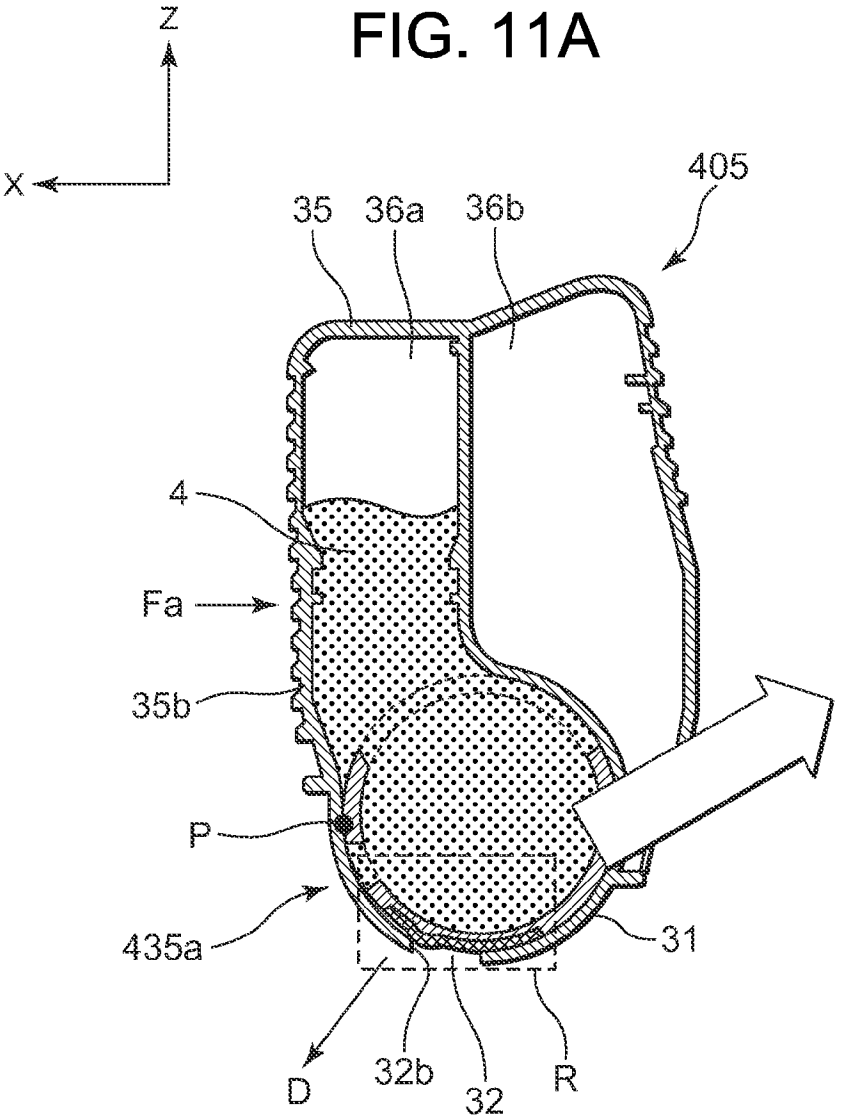
FIG. 11A is a cross-sectional view of the toner cartridge according to the first comparison example, when the external force Fa is applied from the side in the condition where the shutter is in the closed position.

FIG. 9 is a bottom view of the toner cartridge 405 ("the cartridge") of the first comparison example. FIG. 10A is a cross-sectional view of the cartridge 405. FIG. 10B is an enlarged cross-sectional view of the cartridge 405 in an area R of FIG. 10A. FIG. 11A is a cross-sectional view of the cartridge 405, when the external force Fa is applied from the side in the condition where the shutter 31 is in the closed position. FIG. 11B is an enlarged cross-sectional view of the cartridge 405 in an area R of FIG. 11A. In FIG. 11A, the cartridge 405 is fastened so as not to move in the direction of the force Fa.

As shown in FIGS. 9, 10A and 10B, the cartridge 405 of the first comparison example does not have the ribs 33 at its bottom portion 435*a*. As shown in FIG. 11A, when the external force Fa is applied to a mid-portion of a side wall 35*b* in the vertical and longitudinal directions (i.e., in the Z-axis and Y-axis directions), the side wall becomes deformed in the direction of the force Fa. At this time, an end portion 32*b* of the opening 32 moves in the direction of arrow D about a contact point P between the shutter 31 and the internal wall of the housing 35. Consequently, as shown in FIG. 11B, gaps are formed between the inner surface 32*a* and the sealing member 34 of the shutter 31, and the toner 4 in the toner supply chamber 36*a* leaks from the opening 32 through the gaps.

As shown in FIG. 8A, in the cartridge 5 of the first disclosed embodiment, when the external force Fa is applied to the mid-portion of the side wall 35*b*, the side wall becomes deformed in the direction of the force Fa. At this time, a force that moves the end portion 32*b* in the direction of arrow D about the contact point P is generated. However, the rigidity of the bottom portion 35*a* has been enhanced by the ribs 33. Therefore, if the force Fa is equal to or less than a predetermined value, e.g., 3 kgf, the cartridge 5 can prevent the opening 32 from being deformed, thereby preventing gaps from being formed between the inner surface 32*a* and the sealing member 34 of the shutter 31.

In addition, as shown in FIG. 3, the ribs 33 extend in the sliding direction of the shutter 31, i.e., in the rotational direction of the shutter 31. Therefore, the cartridge 5 can prevent the bottom portion 35*a* from being deformed by a rotational load from the shutter 31.

Figure 12B:
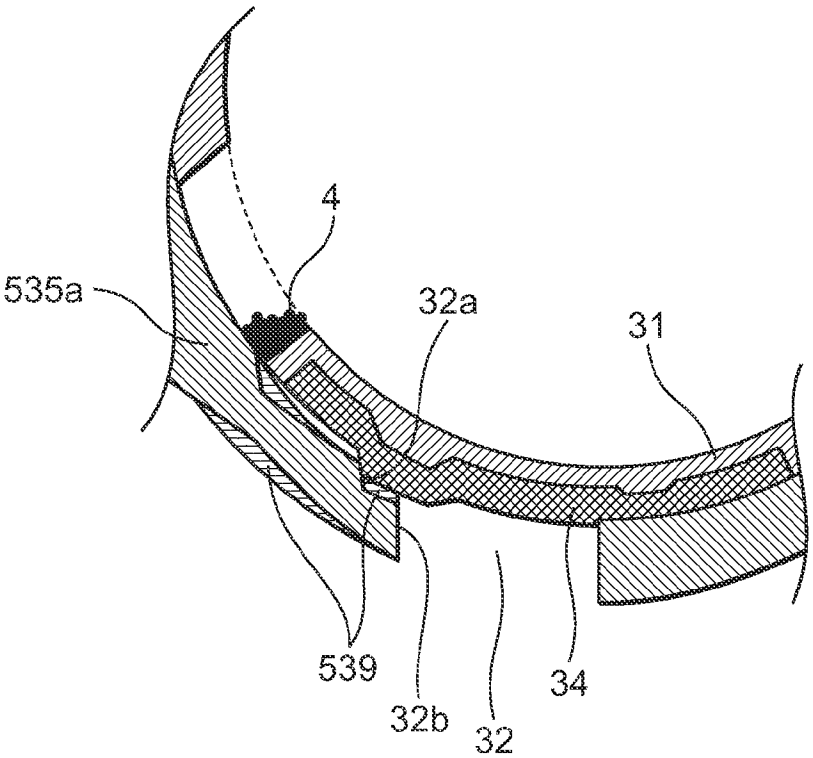
FIG. 12B is an enlarged cross-sectional view of the toner cartridge in an area R of FIG. 12A.
Figure 12A:
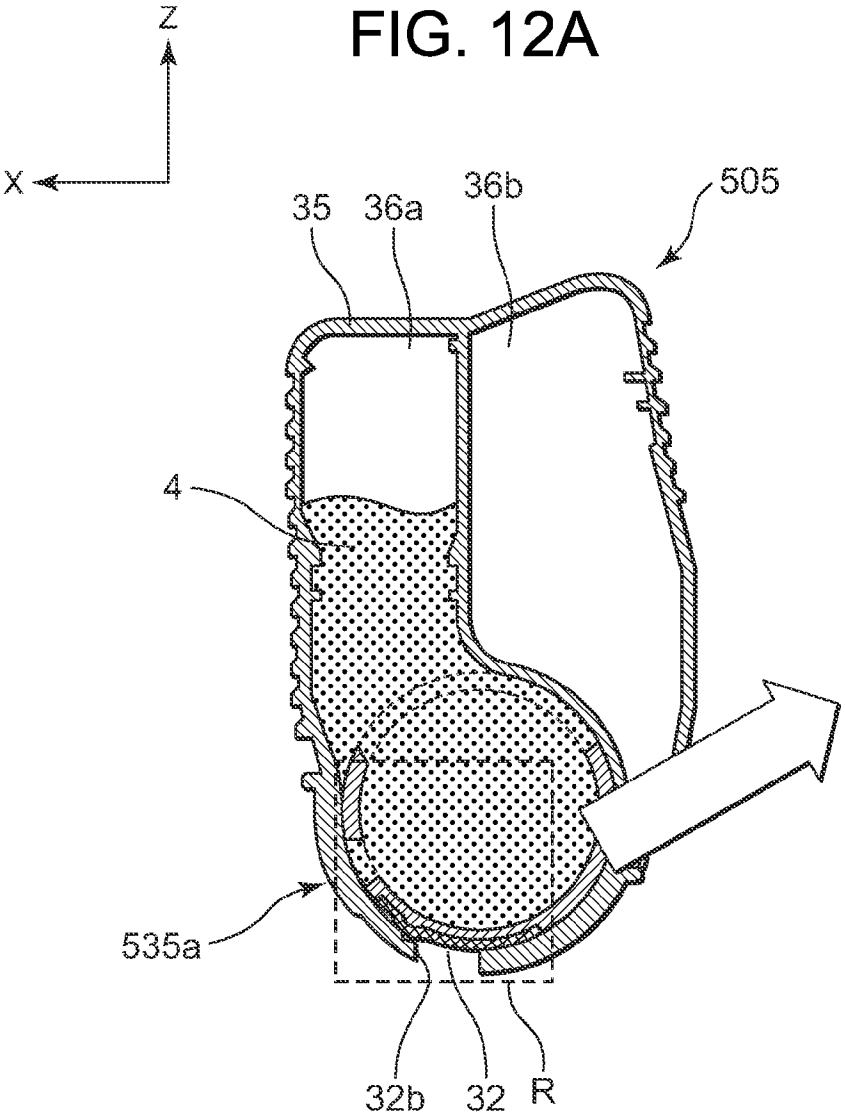
FIG. 12A is a cross-sectional view of a toner cartridge according to a second comparison example.

FIG. 12A is a cross-sectional view of the toner cartridge ("the cartridge") 505 of the second comparison example. FIG. 12B is an enlarged cross-sectional view of the cartridge 505 in an area R of FIG. 12A.

As shown in FIGS. 12A and 12B, in the cartridge 505, a bottom portion 535*a* has the thickness that is greater than that of the cartridge 5 of the first disclosed embodiment so as to prevent the opening 32 from being deformed. However, to simply increase the thickness of the bottom portion 535*a* causes sink marks 539 to form in the vicinity of the opening 32 when the housing 35 is made by mold injection. Consequently, gaps are formed between the inner surface 32*a* and the sealing member 34 of the shutter 31, and the toner 4 in the toner supply chamber 36*a* leaks from the opening 32 through the gaps.

Subsequently, a case where an external force Fb is applied to each of the cartridge 5 of the first disclosed embodiment and the cartridge 405 of the first comparison example will be described.

Figure 13:
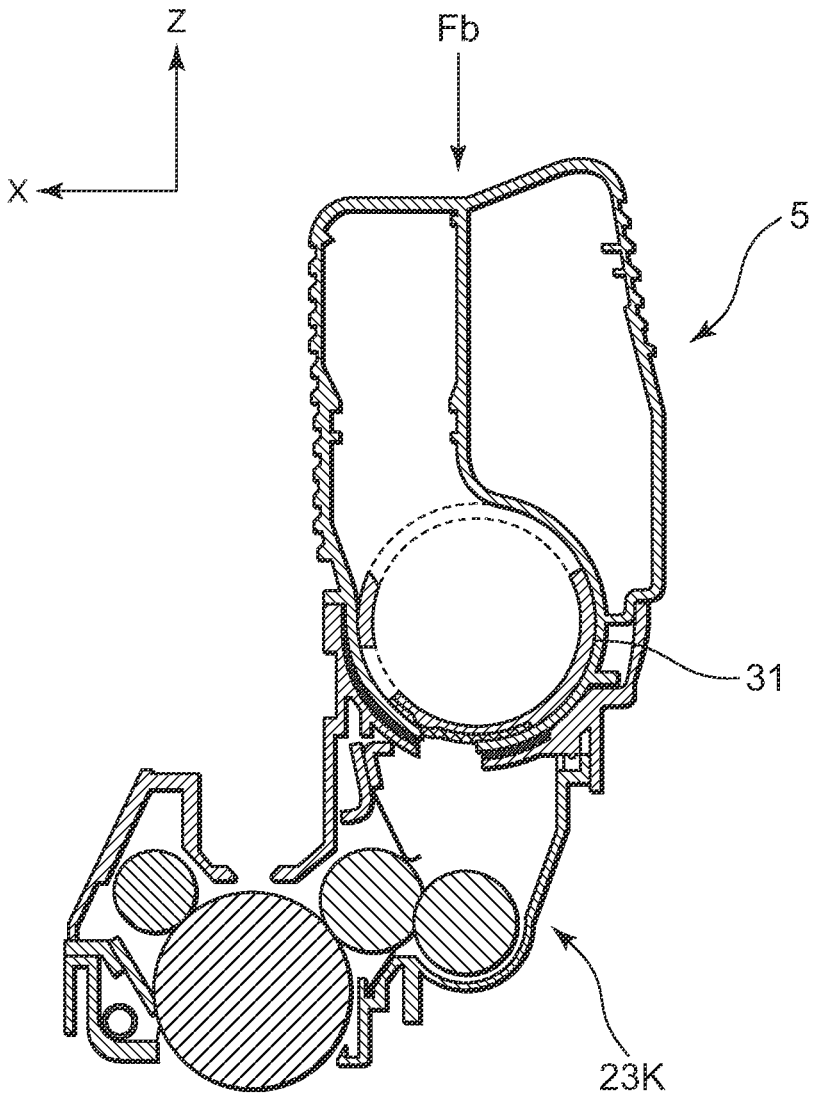
FIG. 13 is a cross-sectional view of the toner cartridge of the first disclosed embodiment and the image-forming unit, when an external force Fb is applied from above in the condition where the shutter is in the closed position.

FIG. 13 is a cross-sectional view of the cartridge 5 and the image-forming unit 23K, when the external force Fb is applied from above in the condition where the shutter 31 is in the closed position. The force Fb can be applied when a user pushes the cartridge 5 down on the image-forming unit 23K to install it.

Figure 14B:
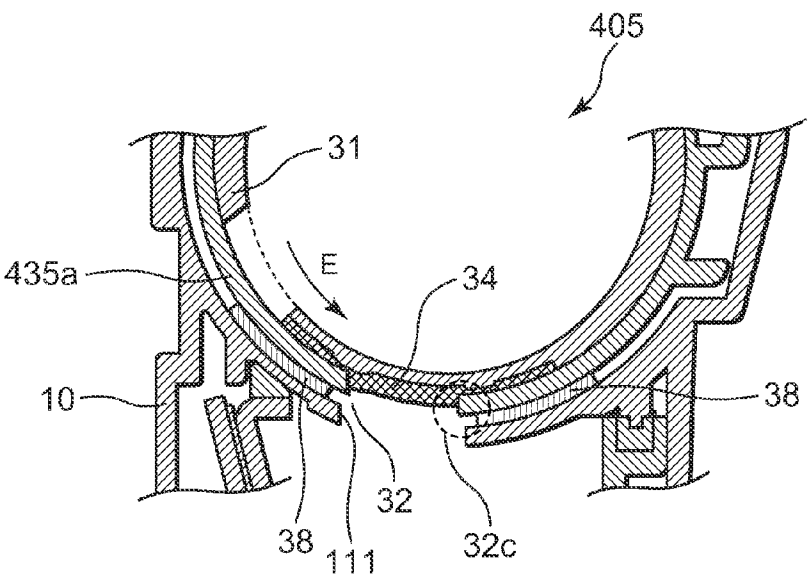
FIG. 14B is an enlarged cross-sectional view in the vicinity of the opening of the toner cartridge according to the first comparison example, when the force Fb is applied from above in the condition where the shutter is in the closed position.
Figure 14A:
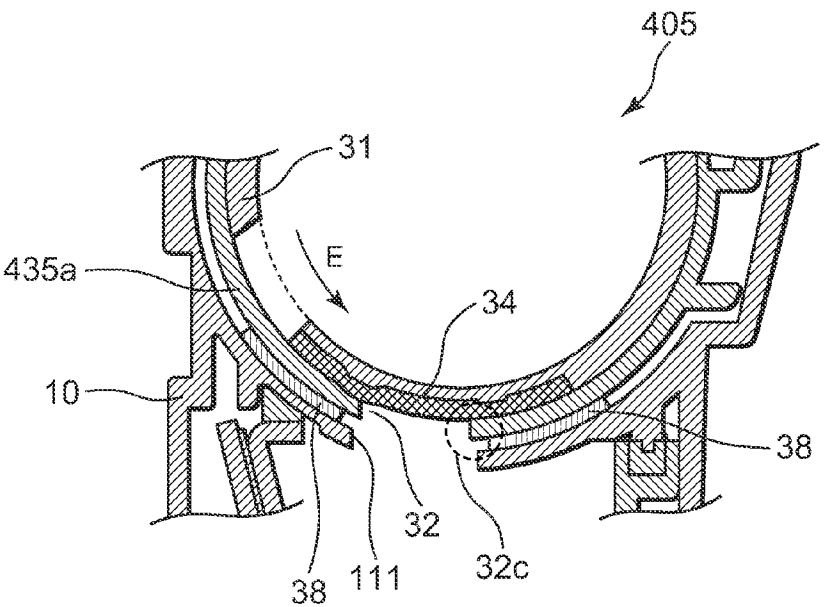
FIG. 14A is an enlarged cross-sectional view in the vicinity of an opening of the toner cartridge according to the first comparison example, when the external force Fb is not applied in the condition where the shutter is in the closed position.

FIG. 14A is an enlarged cross-sectional view in the vicinity of the opening 32 of the cartridge 405 of the first comparison example, when the external force Fb is not applied in the condition where the shutter 31 is in the closed position. FIG. 14B is an enlarged cross-sectional view in the vicinity of the opening 32 of the cartridge 405, when the force Fb is applied from above in the condition where the shutter 31 is in the closed position.

As shown in FIG. 14A, when the external force Fb is not applied to the cartridge 405, an end portion 32*c* of the opening 32, which is enclosed by a dashed line, does not become deformed. Therefore, the shutter 31 can smoothly rotate in the direction of arrow E.

As shown in FIG. 14B, however, when the external force Fb is applied to the cartridge 405 from above, the end portion 32*c* is subjected to a reaction force from the sealing member 38 provided in the vicinity of the toner inlet 111 of the image-forming unit 23K. Consequently, the end portion 32*c* is displaced in the opposite direction of the force Fb, i.e., upwardly, and bites into the sealing member 34. As a result, the shutter 31 may be unable to slide in the direction of arrow E to open the opening 32 because of the increased rotational load.

In the cartridge 5 of the first disclosed embodiment, however, the rigidity of the bottom portion 35*a* has been enhanced by the ribs 33. Therefore, the cartridge 5 can prevent the bottom portion 35*a* from being deformed and can allow the opening 22 to open smoothly, even if the external force Fb is applied from above.

In the first disclosed embodiment, the ribs 33 are formed at a right angle with the longitudinal direction of the housing 35 (i.e., the Y-axis direction). However, in other embodiments, the ribs 33 may be formed parallel to the longitudinal direction of the housing 35.

As described above, in the first disclosed embodiment, the cartridge 5 has ribs 33 in the vicinity of the opening 32 at the bottom portion 35*a*. Therefore, the cartridge 5 can prevent the opening 32 from being deformed even if an external force is applied when the cartridge 5 is replaced with a new one, thereby preventing the toner 4 from leaking from the opening 32. In addition, the cartridge 5 can prevent the rotational load of the shutter 31 from increasing because of the external force.

Second Disclosed Embodiment

Figure 15:
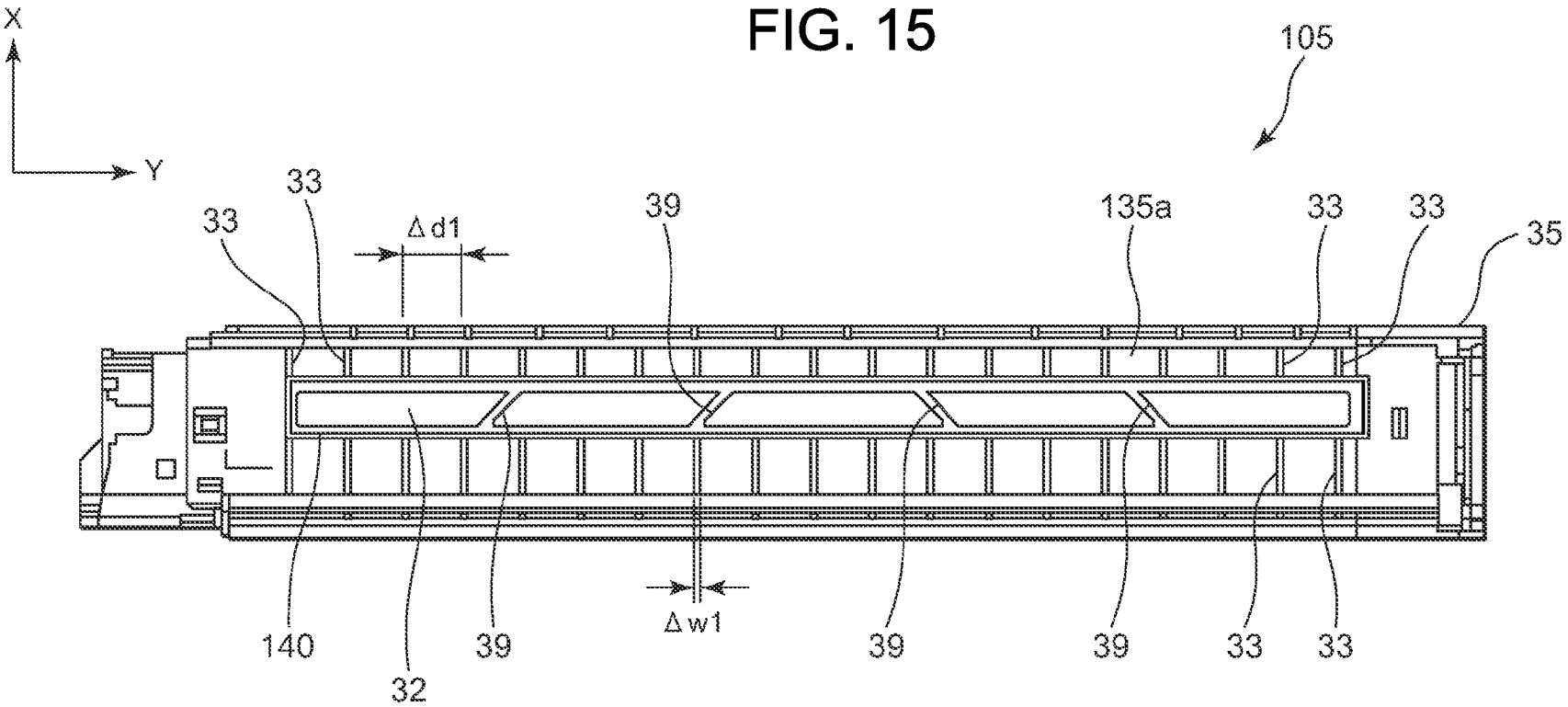
FIG. 15 is a bottom view of a toner cartridge according to a second disclosed embodiment.
Figure 16B:
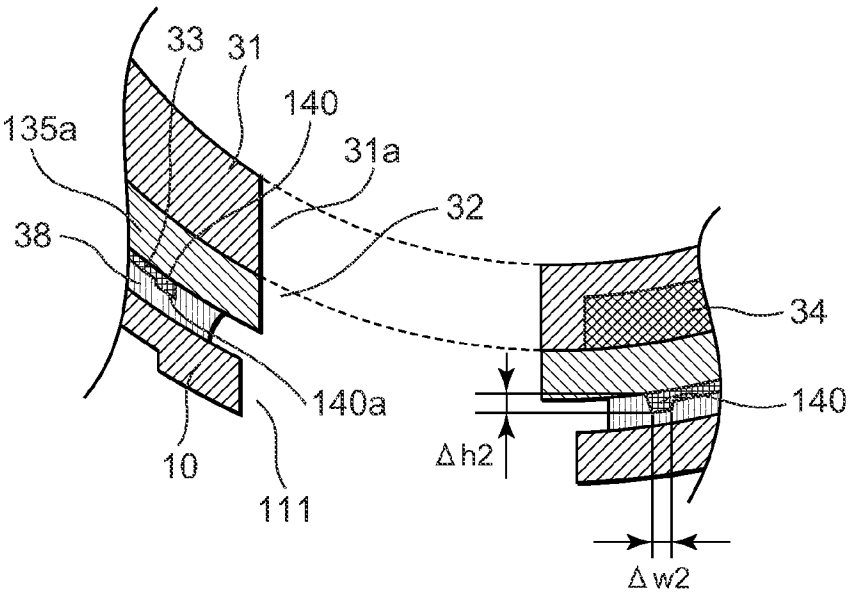
FIG. 16B is an enlarged cross-sectional view of the toner cartridge and the image-forming unit in an area R of FIG. 16A.
Figure 16A:
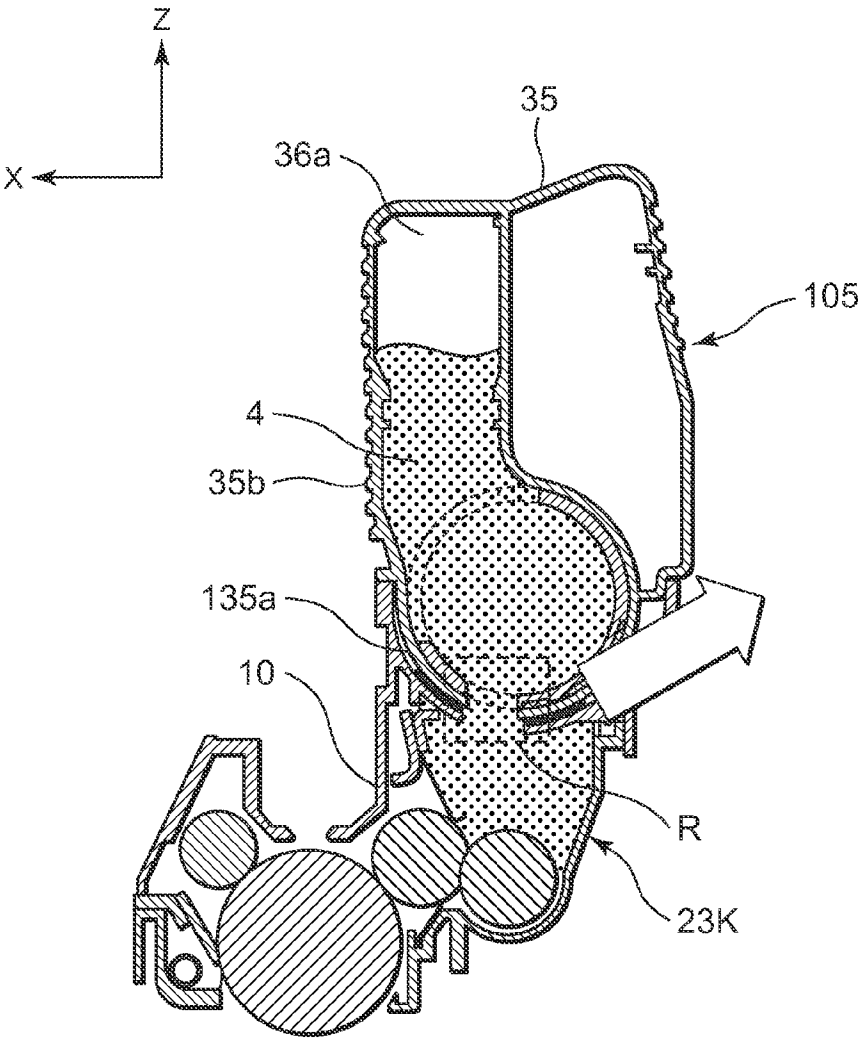
FIG. 16A is a cross-sectional view of the toner cartridge according to the second disclosed embodiment and the image-forming unit.
Figure 17B:
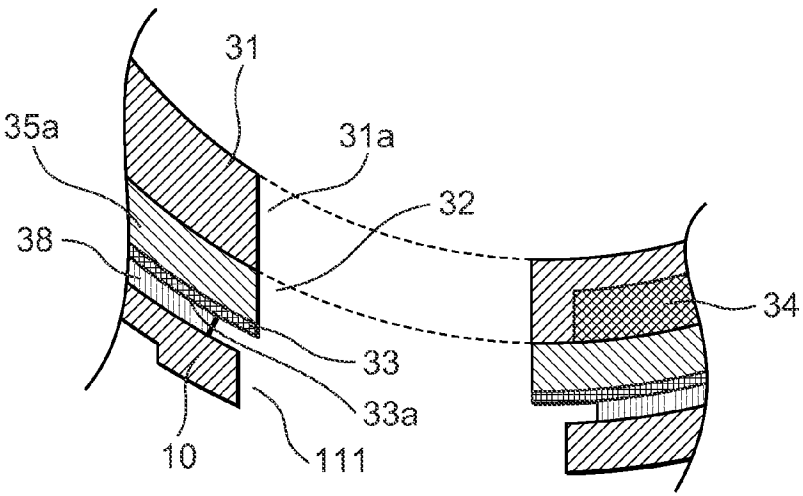
FIG. 17B is an enlarged cross-sectional view of the toner cartridge and the image-forming unit in an area R of FIG. 17A.
Figure 17A:
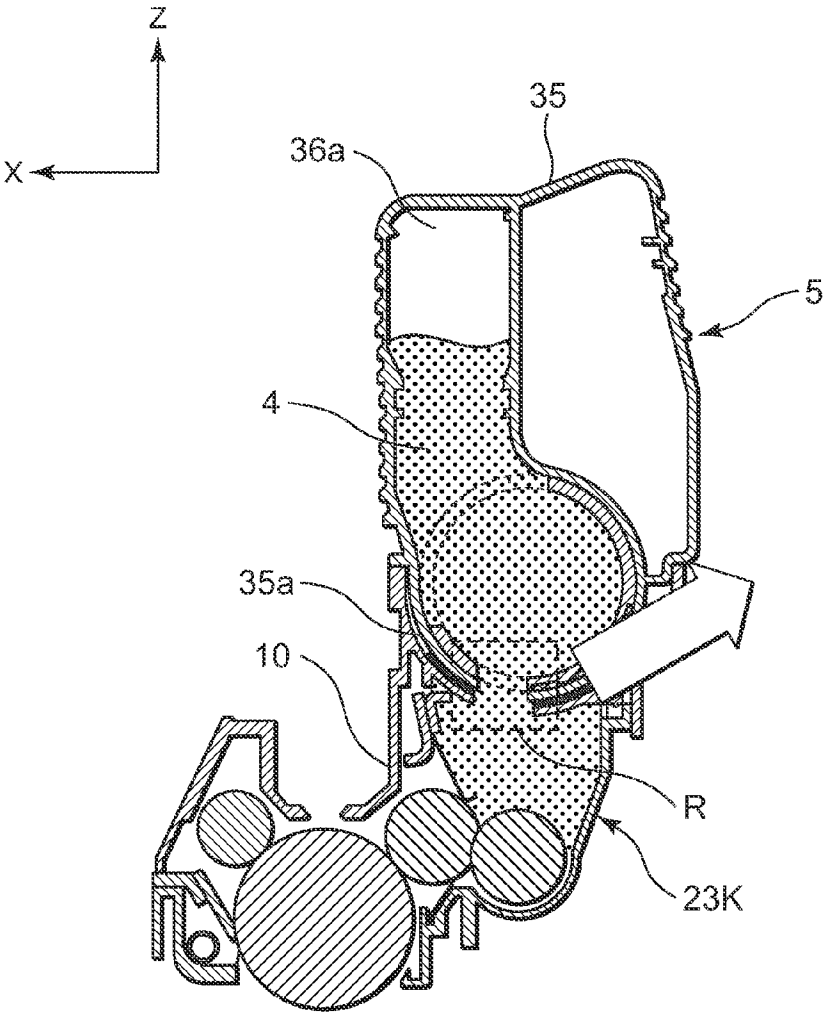
FIG. 17A is a cross-sectional view of the toner cartridge according to the first disclosed embodiment and the image-forming unit.

FIG. 15 is a bottom view of a toner cartridge ("the cartridge") 105 of a second disclosed embodiment. FIG. 16A is a cross-sectional view of the cartridge 105 and the image-forming unit 23K. FIG. 16B is an enlarged cross-sectional view of the cartridge 105 and the image-forming unit 23K in an area R of FIG. 16A. FIG. 17A is a cross-sectional view of the cartridge 5 of the first disclosed embodiment and the image-forming unit 23K. FIG. 17B is an enlarged cross-sectional view of the cartridge 5 and the image-forming unit 23K in an area R of FIG. 17A.

As shown in FIG. 15, in addition to the ribs 33, the cartridge 105 of the second disclosed embodiment has a rib 140, provided at a bottom portion 135*a* as a second projection, which surrounds the opening 32. The other structural elements of the cartridge 105 are similar to those of the cartridge 5 of the first disclosed embodiment. Therefore, elements similar to those in the first disclosed embodiment have been given the same numerals and their description is partially omitted.

As described above, the cartridge 105 has the rib 140 at the bottom portion 135*a*. The rib 140 surrounds the opening 32 at a predetermined distance from the opening 32. As shown in FIG. 16B, the rib 140 has a width Δw2 and a height Δh2. The height Δh2 is greater than the height Δh1 of the ribs 33. In the second disclosed embodiment, the width Δw2 and the height Δh2 are both 0.5 mm. It should be noted that the ribs 33 are not formed between the rib 140 and the opening 32.

As shown in FIGS. 16A and 16B, when the cartridge 105 is mounted on the image-forming unit 23K, the ribs 33 and the rib 140 are forced into the sealing member 38 provided in the vicinity of the toner inlet 111.

Next, advantages of the rib 140 of the cartridge 105 of the second disclosed embodiment will be described in comparison to the cartridge 5 of the first disclosed embodiment. Here, a case where an unexpected shock is applied to each of the cartridges 5 and 105 mounted on the image-forming unit 23K will be described.

As shown in FIGS. 17A and 17B, when the cartridge 5 of the first disclosed embodiment is mounted on the image-forming unit 23K, the ribs 33 are forced into the sealing member 38. However, when an unexpected shock is applied to the cartridges 5 and the image-forming unit 23K, gaps are liable to be formed at a contact surface 33*a* between the ribs 33 and the sealing member 38, and at a contact surface between the bottom portion 35*a* and the sealing member 38. Consequently, the toner 4 might leak out of the image-forming unit 23K through the gaps.

On the other hand, as shown in FIGS. 16A and 16B, when the cartridge 105 of the second disclosed embodiment is mounted on the image-forming unit 23K, the rib 140, which surrounds the opening 32, is forced deeply into the sealing member 38. Therefore, no gap is formed at a contact surface 140*a* between the rib 140 and the sealing member 38, even if an unexpected shock is applied to the cartridges 105 and the image-forming unit 23K.

As described above, in the second disclosed embodiment, the cartridge 105 has the rib 140, which surrounds the opening 32, at the bottom portion 135*a*. As a result, the cartridge 105 can prevent the toner 4 from leaking out of the image-forming unit 23K even if an unexpected shock is applied in the condition where the cartridge 105 is mounted on the image-forming unit 23K.

Third Disclosed Embodiment

Figure 18:
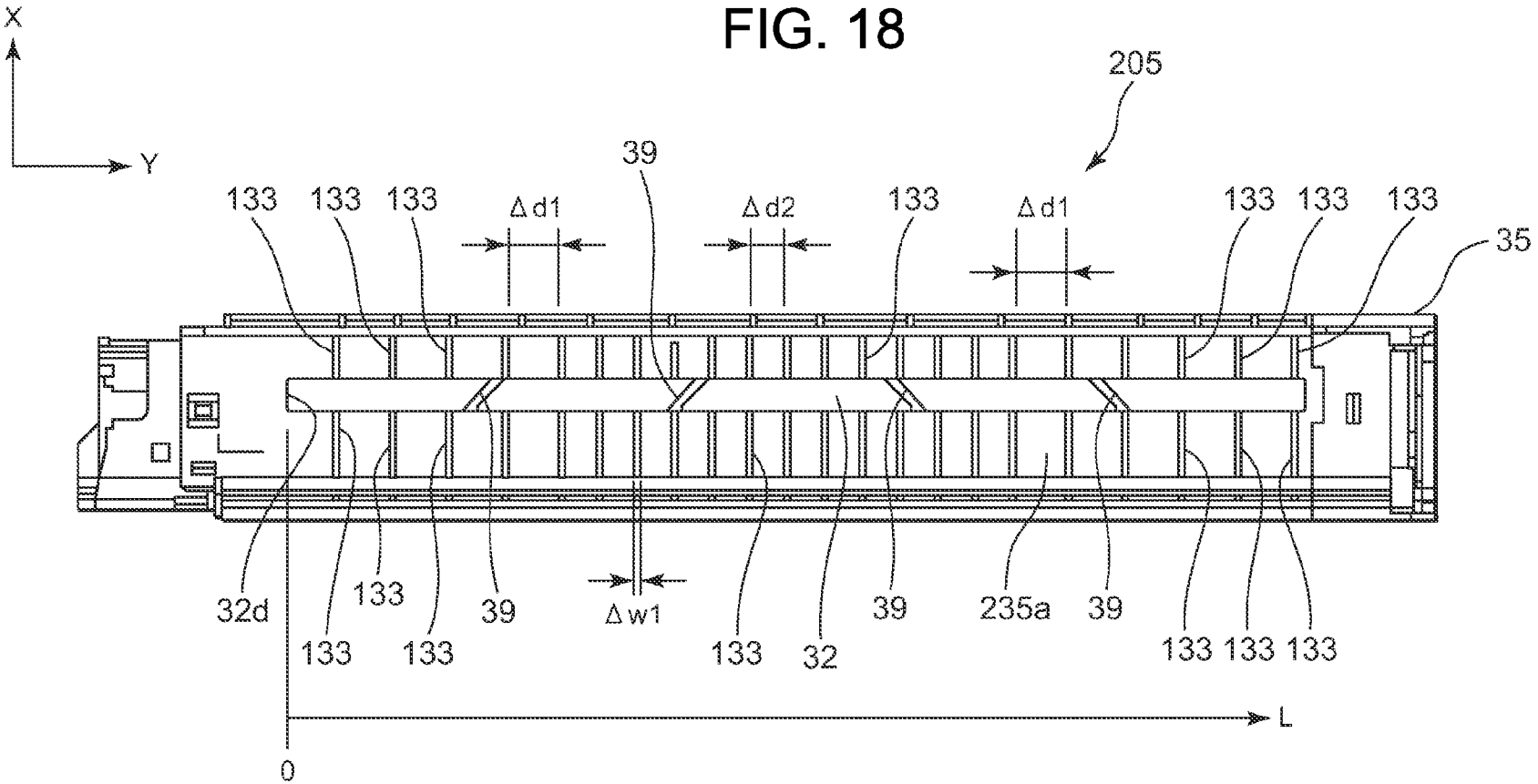
FIG. 18 is a bottom view of a toner cartridge according to a third disclosed embodiment.
Figure 19B:
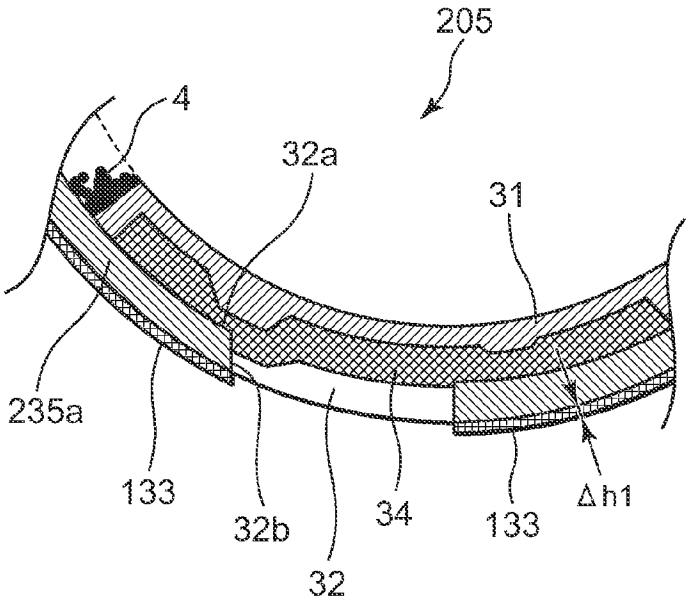
FIG. 19B is an enlarged cross-sectional view of the toner cartridge in an area R of FIG. 19A.
Figure 19A:
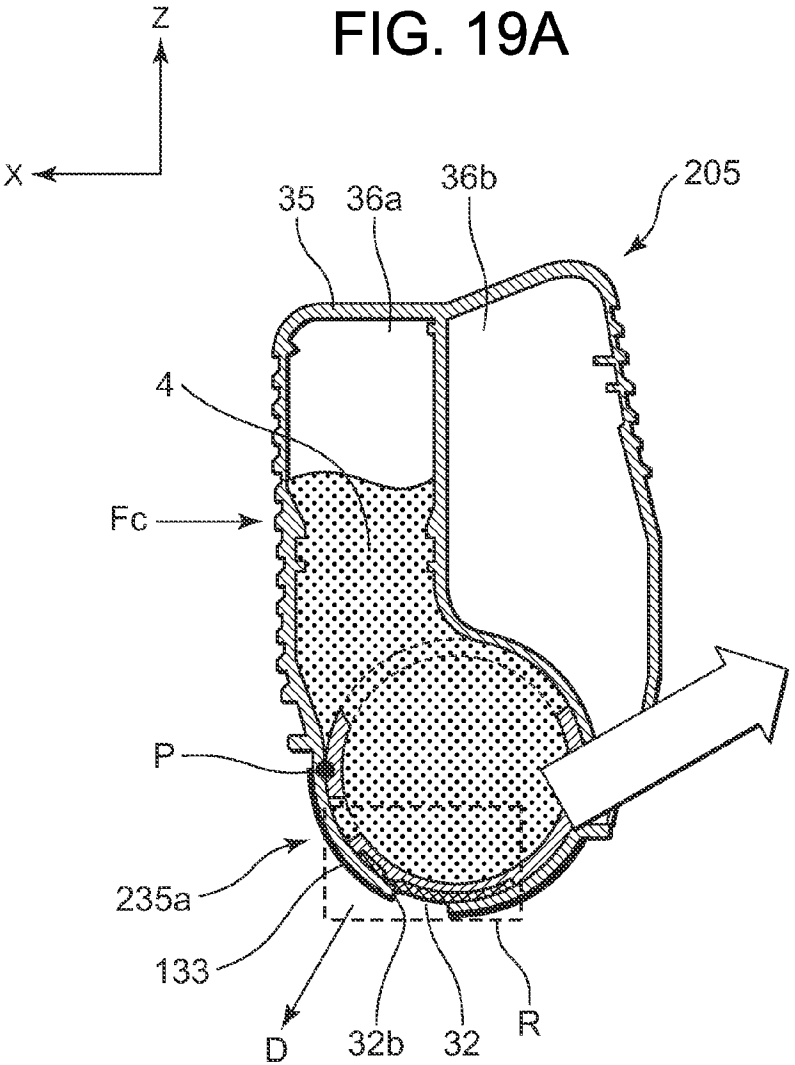
FIG. 19A is a cross-sectional view of the toner cartridge according to the third disclosed embodiment.

FIG. 18 is a bottom view of a toner cartridge ("the cartridge") 205 of a third disclosed embodiment. FIG. 19A is a cross-sectional view of the cartridge 205. FIG. 19B is an enlarged cross-sectional view of the cartridge 205 in an area R of FIG. 19A.

As shown in FIG. 18, the cartridge 205 of the third disclosed embodiment has ribs 133 that operate as first projections at a bottom portion 235*a*. The ribs 133 are arranged in a different way from the ribs 33 of the cartridge 5 of the first disclosed embodiment. The other structural elements of the cartridge 205 are similar to those of the cartridge 5. Therefore, elements similar to those in the first disclosed embodiment have been given the same numerals and their description is partially omitted.

As shown in FIG. 18, the ribs 133 are formed over substantially the entire area of the opening 32 in the longitudinal direction of the housing 35 (i.e., in the Y-axis direction). As with the ribs 33, each of the ribs 133 is formed along an imaginary plane perpendicular to the longitudinal direction of the housing 35, and has a width Δw1 and a height Δh1 (See, e.g., FIG. 19B). In addition, a distance Δd2 between the ribs 133 in the central region of the housing 35 is less than the distance Δd1 in the end regions of the housing 35. In other words, the arrangement density of the ribs 133 in the central region is higher than that in the end regions.

In the third disclosed embodiment, the distances Δd1 and Δd2 are respectively 13.5 mm and 8.5 mm. The cartridge 205 in the third disclosed embodiment has 22 ribs 133 on each side of the opening 32, i.e., 44 ribs 133 in total. Specifically, on each side of the opening 32, the cartridge 205 has 13 ribs 133 that are separated from each other at the distance Δd2 in the central region, 4 ribs 133 that are separated from each other at the distance Δd1 in one end region, and 5 ribs 133 that are separated from each other at the distance Δd1 in the other end region. In addition, the opening 32 has the length of 270 mm in the longitudinal direction (i.e., in the Y-axis direction).

Next, advantages of the rib 133 of the cartridge 205 of the second disclosed embodiment will be described in comparison to the cartridge 5 of the first disclosed embodiment. Here, a case where an external force Fc (e.g., 4 kgf), which is larger than the external force Fa (e.g., 3 kgf), is applied to each of the cartridges 5 and 405 will be described. The force Fc is applied in the condition where the shutter 31 is in the closed position.

Figure 20:
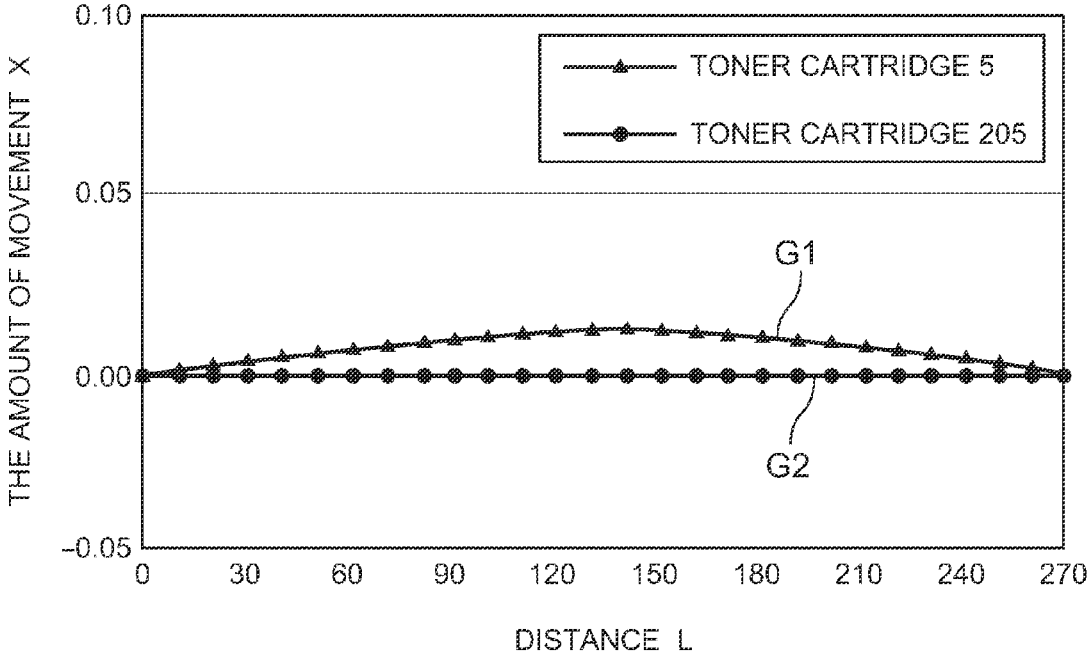
FIG. 20 is a graph showing a relationship between the amount of movement X of an end portion of the opening and a distance L from another end portion of the opening.

FIG. 20 is a graph showing a relationship between the amount of movement X of the end portion 32*b* (See, e.g., FIG. 19A) of the opening 32 and a distance L from an end portion 32*d* (See, e.g., FIG. 18) of the opening 32. In FIG. 20, ordinate and abscissa axes respectively denote the amount of movement X and the distance L. The amount of movement X is the amount of displacement of the end portion 32*b* in the direction of arrow D in FIGS. 8A and 19A.

As shown in FIG. 8A, in the cartridge 5 of the first disclosed embodiment, when the external force Fc is applied to the mid-portion of the side wall 35*b* in the vertical and longitudinal directions (i.e., in the Z-axis and Y-axis directions), the side wall becomes deformed in the direction of the force Fc. At this time, a force that moves the end portion 32*b* in the direction of arrow D about the contact point P is generated. As shown in a graph line G1 in FIG. 20, the nearer to the central region of the housing 35, the larger the amount of movement X of the end portion 32*b*. Therefore, the toner 4 might leak from the opening 32 around the central region of the cartridge 5.

As shown in FIG. 19A, in the cartridge 205 of the third disclosed embodiment, when the external force Fc is applied to the mid-portion of the side wall 35*b*, the side wall becomes deformed in the direction of the force Fc. At this time, a force that moves the end portion 32*b* in the direction of arrow D about the contact point P is generated. However, as described above, the arrangement density of the ribs 133 in the central region is higher than that in the end regions. In other words, the rigidity of the bottom portion 235*a* in the central region is higher than that in the end regions. Therefore, as shown in a graph line G2 in FIG. 20, the end portion 32*b* moves little or not at all.

In the third disclosed embodiment, the ribs 133 are arranged at two different distances from each other, i.e., the distances Δd1 and Δd2. However, in alternate embodiments the ribs 133 may be arranged at three or more different distances from each other, with the distances decreasing as the ribs 133 approach the central region.

As described above, in the third disclosed embodiment, the arrangement density of the ribs 133 in the central region of the housing 35 is higher than that in the end regions, thereby enhancing the rigidity of the bottom portion 235*a* in the central region. Therefore, the cartridge 205 can increase its resistance to an external force much more than the cartridge 5 of the first disclosed embodiment.

Fourth Disclosed Embodiment

Figure 21:
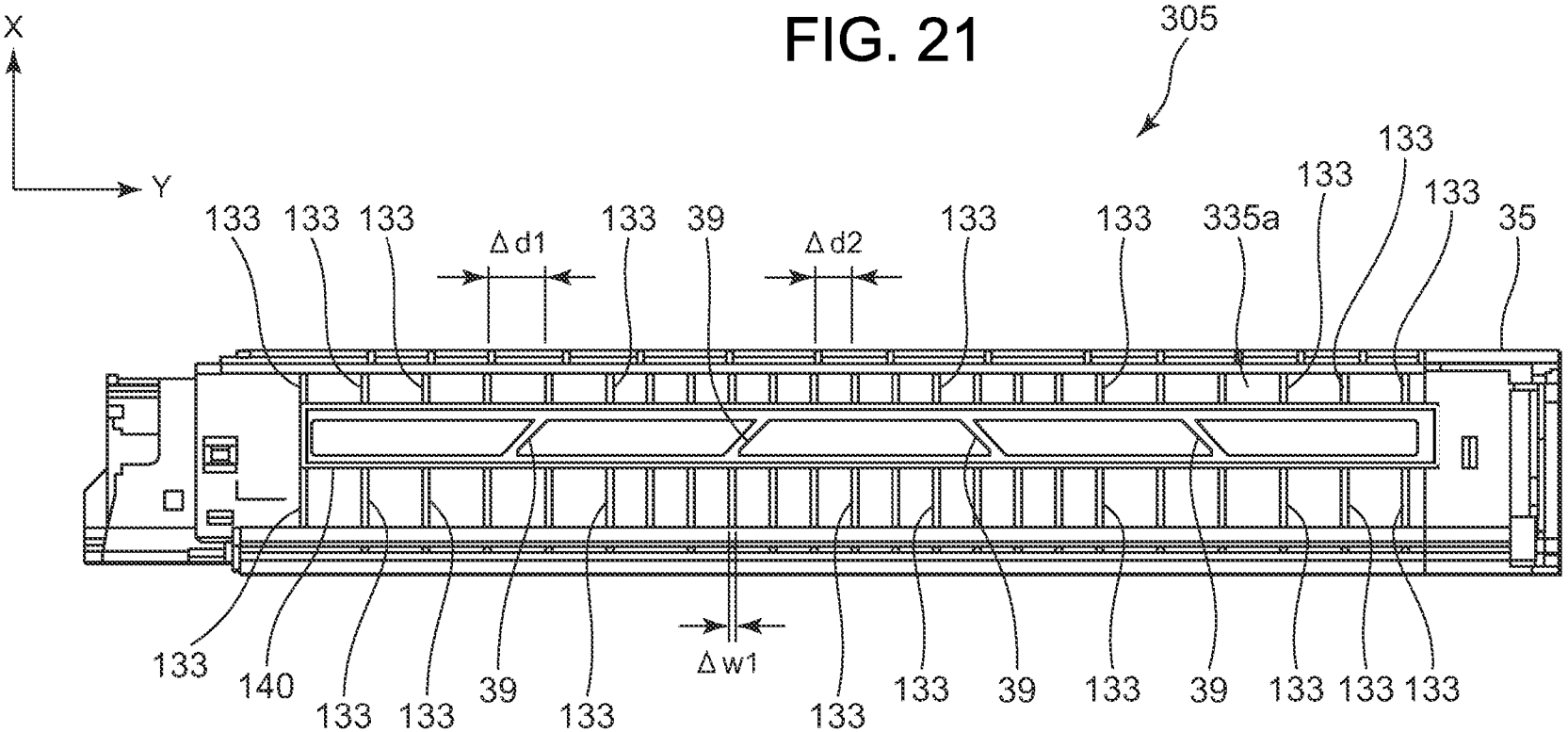
FIG. 21 is a bottom view of a toner cartridge according to a fourth disclosed embodiment.

FIG. 21 is a bottom view of a toner cartridge ("the cartridge") 305 of a fourth disclosed embodiment. As shown in FIG. 21, the cartridge 305 of the fourth disclosed embodiment shares features of both the cartridge 105 of the second disclosed embodiment and the cartridge 205 of the third disclosed embodiment. In other words, similar to the cartridge 105, the cartridge 305 has a rib 140, which surrounds the opening 32 at a predetermined distance from the opening 32, formed at its bottom portion 335*a*. In addition, similar to the cartridge 205, the cartridge 305 has ribs 133 at the bottom portion 335*a*. Each of the ribs 133 is formed along an imaginary plane perpendicular to the longitudinal direction of the housing 35, and the distance Δd2 between the ribs 133 in the central region of the housing 35 is less than the distance Δd1 in the end regions of the housing 35. Moreover, the ribs 133 are not formed between the rib 140 and the opening 32.

Therefore, the cartridge 305 can prevent the toner 4 from leaking out of the image-forming unit 23K even if an unexpected shock is applied in the condition where the cartridge 305 is mounted on the image-forming unit 23K. In addition, the cartridge 305 can increase its resistance to an external force much more so than the cartridge 5 of the first disclosed embodiment.

While each of the embodiments has been described with respect to an electrophotographic color printer, the disclosed systems may also be applicable to a facsimile machine, a copier, or a multifunction peripheral (MFP).

The developer cartridge, the image forming unit, and the image forming apparatus being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. A developer cartridge comprising:

a developer container that holds a developer;

an opening that is formed on the developer container and extends in a longitudinal direction of the developer container;

a first projection that is formed in the vicinity of the opening; and a second projection that surrounds the opening, wherein a height of the second projection is greater than a height of the first projection, and the first projection is integrally formed with the second projection.

2. The developer cartridge according to claim 1, wherein the first projection is formed along an imaginary plane perpendicular to the longitudinal direction.

3. The developer cartridge according to claim 1, wherein a plurality of the first projections are formed on the developer container at regular intervals in the longitudinal direction, and wherein the plurality of first projections are each formed along a respective imaginary plane perpendicular to the longitudinal direction.

4. The developer cartridge according to claim 3, further comprising a shutter that is slidable in the developer container and opens and closes the opening.

5. The developer cartridge according to claim 4, wherein the first projections extend in a sliding direction of the shutter.

6. The developer cartridge according to claim 4, wherein the shutter rotates around a rotational axis that extends in the longitudinal direction, and the first projections extend in a rotational direction of the shutter.

7. The developer cartridge according to claim 1, wherein the opening is formed at a bottom portion of the developer container.

8. The developer cartridge according to claim 7, wherein a cross-section of the bottom portion perpendicular to the longitudinal direction is arc-shaped.

9. An image forming unit comprising:

an image bearing body on which an electrostatic latent image is formed;

a developing unit configured to develop the electrostatic latent image with a developer; and the developer cartridge according to claim 1, the developer cartridge being configured to supply the developer to the developing unit.

10. The image forming unit according to claim 9, further comprising:

a developer inlet that opposes the opening; and a sealing member that is provided in the vicinity of the developer inlet.

11. An image forming apparatus comprising:

the image forming unit according to claim 9 that forms an image;

a transfer unit that transfers the image to a medium; and a fixing unit that fixes the image onto the medium.

12. The developer cartridge according to claim 1, wherein the first projection extends away from the second projection.

13. The developer cartridge according to claim 1, wherein the second projection is positioned between the opening and the first projection.

14. The developer cartridge according to claim 1, wherein a width of the second projection is substantially equal to the height of the second projection.

15. The developer cartridge according to claim 1, wherein the first projection and the second projection are integrally formed with the developer container.

16. A developer cartridge, comprising:

a developer container that holds a developer, the developer container including an opening that extends in a longitudinal direction of the developer container;

a plurality of first projections that are formed at least partially in the vicinity of the opening along a plurality of respective imaginary planes perpendicular to the longitudinal direction; and a second projection that surrounds the opening, wherein a height of the second projection is greater than a height of the plurality of first projections, and the plurality of first projections are integrally formed with the second projection.

17. The developer cartridge according to claim 16, wherein the plurality of first projections are ribs formed around the developer container.

18. The developer cartridge according to claim 16, further comprising a shutter that is slidable into the developer container and opens and closes the opening, wherein the shutter rotates around a rotational axis that extends in the longitudinal direction, and wherein the plurality of first projections extend in a rotational direction of the shutter.

19. The developer cartridge according to claim 16, wherein a width of the second projection is substantially equal to the height of the second projection.

20. The developer cartridge according to claim 16, wherein the plurality of first projections and the second projection are integrally formed with the developer container.

21. A developer cartridge comprising:

a developer container that holds a developer;

an opening that is formed on the developer container and extends in a longitudinal direction of the developer container; and a first projection that is formed in the vicinity of the opening, wherein a plurality of the first projections are formed on the developer container in the longitudinal direction, the plurality of first projections are each formed along a respective imaginary plane perpendicular to the longitudinal direction, and a distance between adjacent first projections in a central region of the developer container is less than a distance between adjacent first projections in an end region of the developer container.

22. A developer cartridge, comprising:

a developer container that holds a developer, the developer container including an opening that extends in a longitudinal direction of the developer container; and a plurality of first projections that are formed at least partially in the vicinity of the opening along a plurality of respective imaginary planes perpendicular to the longitudinal direction, wherein a distance between a first pair of adjacent first projections in a central region of the developer container is less than a distance between a second pair of adjacent first projections in an end region of the developer container.

23. A developer cartridge comprising:

a developer container that holds a developer;

an opening that is formed on the developer container and extends in a longitudinal direction of the developer container;

a first projection that is formed in the vicinity of the opening; and a second projection that surrounds the opening, wherein a height of the second projection is greater than a height of the first projection, and the first projection and the second projection are integrally formed with the developer container.

24. A developer cartridge, comprising:

a developer container that holds a developer, the developer container including an opening that extends in a longitudinal direction of the developer container;

a plurality of first projections that are formed at least partially in the vicinity of the opening along a plurality of respective imaginary planes perpendicular to the longitudinal direction; and a second projection that surrounds the opening, wherein a height of the second projection is greater than a height of the plurality of first projections, and the plurality of first projections and the second projection are integrally formed with the developer container.

* * * * *